US009020374B2

(12) United States Patent
Hamano et al.

(10) Patent No.: US 9,020,374 B2
(45) Date of Patent: Apr. 28, 2015

(54) DEVELOPER TRANSPORT UNIT, IMAGE FORMING APPARATUS, METHOD OF TRANSPORTING DEVELOPER, PROGRAM FOR TRANSPORTING DEVELOPER, AND STORAGE MEDIUM STORING THE PROGRAM

(75) Inventors: Toshihiro Hamano, Mito (JP); Shigeru Tosa, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 174 days.

(21) Appl. No.: 12/911,303

(22) Filed: Oct. 25, 2010

(65) Prior Publication Data

US 2011/0097094 A1 Apr. 28, 2011

(30) Foreign Application Priority Data

Oct. 26, 2009 (JP) ..... 2009-245958

(51) Int. Cl.
*G03G 15/08* (2006.01)

(52) U.S. Cl.
CPC ..... *G03G 15/0879* (2013.01); *G03G 15/0862* (2013.01); *G03G 2215/0665* (2013.01); *G03G 15/0877* (2013.01); *G03G 15/0856* (2013.01); *G03G 15/0863* (2013.01); *G03G 15/0865* (2013.01); *G03G 15/0872* (2013.01); *G03G 15/0855* (2013.01)

(58) Field of Classification Search
CPC ..... G03G 15/0834; G03G 15/0839; G03G 15/0868
USPC ..... 399/27, 262, 263
See application file for complete search history.

(56) References Cited

U.S. PATENT DOCUMENTS

| | | | | |
|---|---|---|---|---|
| 4,212,264 | A * | 7/1980 | Knechtel et al. | 399/261 |
| 4,965,639 | A * | 10/1990 | Manno et al. | 399/262 |
| 5,652,947 | A * | 7/1997 | Izumizaki | 399/58 |
| 7,536,122 | B2 * | 5/2009 | Ohkawa et al. | 399/27 |
| 7,792,441 | B2 | 9/2010 | Akatsu et al. | |
| 2004/0052538 | A1 * | 3/2004 | Yugeta et al. | 399/27 |
| 2004/0234283 | A1 * | 11/2004 | Nishida | 399/27 |
| 2005/0041998 | A1 * | 2/2005 | Fujii et al. | 399/258 |
| 2006/0159472 | A1 * | 7/2006 | Ushiroji et al. | 399/27 |
| 2007/0217798 | A1 * | 9/2007 | Tsuji et al. | 399/27 |

FOREIGN PATENT DOCUMENTS

| | | |
|---|---|---|
| JP | 2006-243707 | 9/2006 |
| JP | 2007-163793 | 6/2007 |
| JP | 2007-316216 | 12/2007 |

* cited by examiner

*Primary Examiner* — Benjamin Schmitt
(74) *Attorney, Agent, or Firm* — Oblon, McClelland, Maier & Neustadt, L.L.P.

(57) ABSTRACT

A developer transport unit which includes an intra-vessel transporting device to transport developer in a developer storage vessel to an ejection unit. The developer storage vessel is detachably attached at one end to an ejection unit. There is a transport/supply device to transport the developer from the ejection unit to a sub-storage vessel, and an intermediate-developer amount detector to obtain an amount of developer present in the sub-storage vessel. Further, there is a control unit to control driving of the intra-vessel transporting device and the transport/supply device.

13 Claims, 18 Drawing Sheets

DEVELOPER TRANSPORT UNIT, IMAGE FORMING APPARATUS, METHOD OF TRANSPORTING DEVELOPER, PROGRAM FOR TRANSPORTING DEVELOPER, AND STORAGE MEDIUM STORING THE PROGRAM

CROSS-REFERENCE TO RELATED APPLICATIONS

This application claims priority to Japanese Patent Application No. 2009-245958, filed on Oct. 26, 2009 in the Japan Patent Office, which is hereby incorporated by reference herein in its entirety.

BACKGROUND OF THE INVENTION

1. Field of the Invention

The present invention relates to a developer transport unit, an image forming apparatus, a method of transporting developer, a program for implementing a method of transporting developer, and a storage medium storing a program, and more particularly to, a developer transport unit, an image forming apparatus, a method of transporting developer, a program for implementing a method of transporting developer, and a storage medium storing a program to supply developer to a development unit from a developer storage vessel via an sub-storage vessel while managing developer supply appropriately by detecting developer amount in the developer storage vessel correctly.

2. Description of the Background Art

Image forming apparatuses using electrophotography conduct image forming operations as follows. An electrostatic latent image formed on a photoconductor is developed as a toner image by a development unit using toner (used as developer), and then the toner image is transferred from the photoconductor to a recording sheet. Such image forming apparatuses may be equipped with a toner supply mechanism, and such toner supply mechanism may use a sub-tank to transport toner from a toner bottle to the development unit. Specifically, toner in the toner bottle is ejected to the sub-tank by a toner pump to store toner in the sub-tank. Then, toner stored in the sub-tank is transported to the development unit by rotating a toner transporting coil when the development unit requires a certain amount of toner, as disclosed, for example, in JP-2007-163793-A.

Further, in such conventional toner supply mechanism, in general a spiral pattern is formed in an internal face of the toner bottle from a bottom side to a toner ejection port of the toner bottle. When the toner bottle rotates, the spiral pattern in the toner bottle moves toner to the toner ejection port, where the toner is transported to the sub-tank by the toner pump.

For optimum imaging, a certain amount of toner is required to be constantly stored in the sub-tank of the toner supply mechanism. To check an amount of toner (toner amount) in the sub-tank, a toner amount sensor such as an electromagnetic sensor is disposed in the sub-tank. In conventional toner supply mechanisms, when the toner amount sensor detects that the toner amount in the sub-tank decreases to a certain amount or less, the toner bottle is rotated and the toner pump is driven simultaneously, moving toner in the toner bottle to a toner ejection port where the toner is transported to the sub-tank by using the toner pump until the toner amount in the sub-tank becomes a certain amount.

However, such conventional technology may have some drawbacks for appropriately managing amount of toner remaining in a toner bottle, and a toner pump for transporting toner from a toner bottle to a sub-tank.

A toner pump takes a certain amount of time (supply time) to supply toner from the toner bottle to the sub-tank, determined by the amount of time needed for the toner in the sub-tank to reach a certain amount, and such supply time may change or vary depending on the amount of toner already in the toner bottle at any given time. For example, when the toner amount in the toner bottle decreases, the toner supply time becomes longer compared to when the toner amount in the toner bottle is in a toner-full condition.

However, in conventional technologies, no consideration may not be given to the fact that the toner amount eject-able from the toner bottle to the sub-tank decreases as the toner amount in the toner bottle decreases. Rather, in conventional technologies, it is assumed that the toner amount in the toner bottle remains constant, and that the toner amount ejected from the toner bottle to the sub-tank is calculated based on a rotation time of the toner bottle. Accordingly, when toner amount in a toner bottle becomes little and toner may not exist near the toner ejection port, the toner bottle needs to be is rotated for a given rotation time so that toner is moved to nearby of toner ejection port in the toner bottle. Although toner may not be ejected from a toner bottle actually during such rotation, in a conventional calculation process for calculating remaining amount of toner, it is assumed that toner is ejected from a toner bottle. As a result, toner remaining amount obtained by conventional calculation and toner remaining amount actually remaining in the toner bottle may have a difference, by which toner empty condition (or no toner condition) cannot be alarmed at a correct timing.

Further, in conventional technologies, when toner amount in a toner bottle decreases, toner may exist at a location far from a toner ejection port of toner bottle but toner may not exist so much at a location nearby of toner ejection port depending on a shape of toner bottle. Even in such condition, in conventional technologies, a toner pump may be rotated simultaneously with a rotation of toner bottle. As a result, the toner pump may suck mostly air in the toner bottle, and air leak may occur due to a characteristic of the toner pump, and a stator in the toner pump may not function properly and the toner pump may malfunction.

SUMMARY

In one aspect of the present invention, a developer transport unit to transport a developing unit used for developing an electrostatic latent image formed on a photoconductor by applying developer is devised. The developer transport unit includes an intra-vessel transporting device, a transport/supply device, an intermediate-developer amount detector, and a control unit. The intra-vessel transporting device transports developer in a developer storage vessel to an ejection unit, and the developer storage vessel is detachably attached at one end to an ejection unit. The transport/supply device transports the developer from the ejection unit to a sub-storage vessel. The intermediate-developer amount detector obtains an amount of developer present in the sub-storage vessel. The control unit controls driving of the intra-vessel transporting device and the transport/supply device.

Detection of a certain amount of developer in the sub-storage vessel by the intermediate-developer amount detector causes the control unit to drive the intra-vessel transporting device for a given time and then drive the transport/supply device along with the intra-vessel transporting device until the intermediate-developer amount detector detects that the sub-storage vessel is refilled with a certain amount of developer.

In another aspect of the present invention, a method of transporting developer to a developing unit used for developing an electrostatic latent image formed on a photoconductor by applying developer is devised. The method includes the steps of: intra-vessel transporting developer in the developer storage vessel to an ejection unit; inter-vessel transporting the developer from the ejection unit to a sub-storage vessel, in which the developer storage vessel is detachably attached at one end to an ejection unit; detecting an amount of the developer in the sub-storage vessel; and controlling a driving of the intra-vessel transporting step and the inter-vessel transporting step. Detection of a certain amount of developer in the sub-storage vessel in the detecting step causes the intra-vessel transporting to be executed for a predetermined period of time after which the inter-vessel transporting is executed along with the intra-vessel transporting until the detecting step detects that the sub-storage vessel is refilled with a certain amount of developer.

In another aspect of the present invention, a computer-readable medium storing a program is devised. The program includes instructions that when executed by a computer cause the computer to execute a method of transporting developer to a developing unit used for developing an electrostatic latent image formed on a photoconductor by applying developer. The method includes the steps of: intra-vessel transporting developer in the developer storage vessel to an ejection unit; inter-vessel transporting the developer from the ejection unit to a sub-storage vessel, in which the developer storage vessel is detachably attached at one end to an ejection unit; detecting an amount of the developer in the sub-storage vessel; and controlling a driving of the intra-vessel transporting step and the inter-vessel transporting step. Detection of a certain amount of developer in the sub-storage vessel in the detecting step causes the intra-vessel transporting to be executed for a predetermined period of time after which the inter-vessel transporting is executed along with the intra-vessel transporting until the detecting step detects that the sub-storage vessel is refilled with a certain amount of developer.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
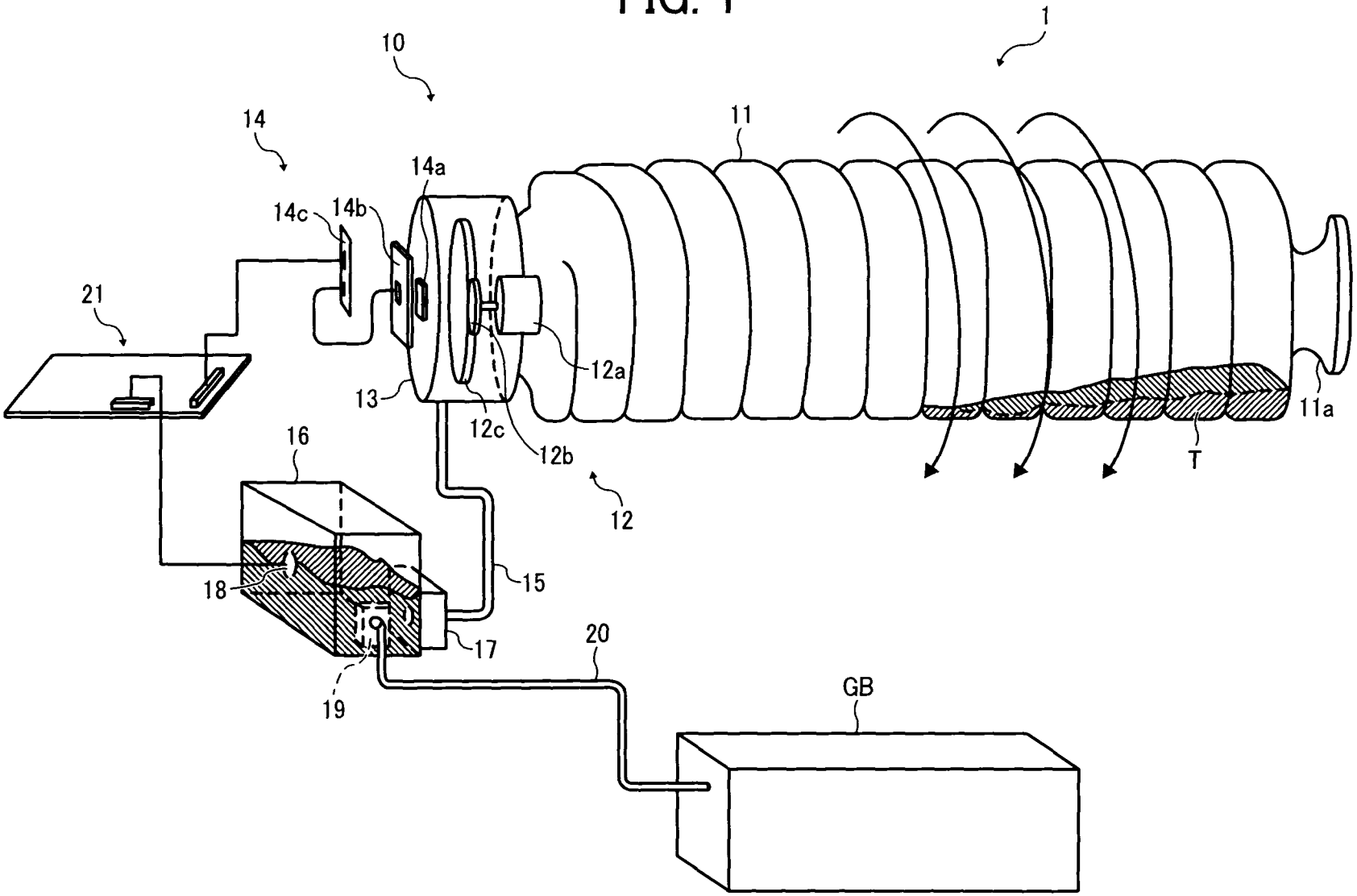
FIG. 1 shows a schematic configuration of a toner transport unit employed for an image forming apparatus according to a first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner. Referring now to the drawings, image forming apparatuses according to example embodiments are described hereinafter.

(First Example Embodiment)

FIGS. 1 to 8 show a developer transport unit, an image forming apparatus, a method of transporting developer, a program for implementing a method of transporting developer, and a storage medium of program according to a first example embodiment. FIG. 1 shows a schematic perspective view of toner supply unit 10 of an image forming apparatus 1, which applies a developer transport unit, an image forming apparatus, a method of transporting developer, a program for implementing a method of transporting developer, and a storage medium of program according to a first example embodiment.

The image forming apparatus 1 of FIG. 1 may employ electrophotography for image forming operations, and such image forming apparatus 1 may be, for example, printers, copiers, facsimile machines, multi-function peripherals (MFP), or the like. An image forming unit of the image forming apparatus 1 may include a photoconductor, and a charger, an optical writing unit, a development unit, a transfer unit, a cleaning unit, and a decharger, in which the photoconductor may be surrounded by other units. In the image forming unit, the photoconductor charged uniformly by the charger is exposed by a laser beam, which is modulated by using image data and control signals and emitted from the optical writing unit, to form an electrostatic latent image on the photoconductor, and then the electrostatic latent image is developed as a toner image by supplying toner T (used as developer) on the photoconductor using a development unit GB (used as a developing device or apparatus). In the image forming unit, a sheet transported by a sheet feeder is fed to a space between the photoconductor and the transfer unit by adjusting a sheet feed timing by registration rollers to a timing of forming toner image on the photoconductor so that the toner image on the photoconductor is transferred to the sheet by the transfer unit, and then the sheet transferred with the toner image is transported to a fixing unit. In the image forming unit, the sheet transferred with the toner image is applied with heat and pressure in the fixing unit while being transported in the fixing unit to fuse the toner image on the sheet. Then, the sheet may be ejected to a sheet ejection tray, or may be transported to a post processor, if connected, to conduct a post processing, as required.

A toner supply unit 10, used as developer transport unit, may include a toner bottle 11, a toner forwarding unit 12, a toner ejection unit 13, a toner remaining amount memory/management unit 14, a toner transport route 15, a sub-tank 16, a mohno-pump 17, a toner-full sensor 18, a toner transport motor 19, a toner transport route 20, and a controller 21, or the like, for example. The toner supply unit 10 is used to supply toner T stored in the toner bottle 11 to a development unit GB in the image forming unit.

The toner bottle 11 (used as a developer supply container or developer storage vessel) may be formed into a cylindrical while forming a support part 11*a* on a bottom face of toner bottle 11, wherein the support part 11*a* may be rotate-ably supported by a support member (not shown). The toner bottle 11 may have an internal face having formed of a spiral pattern extending from the bottom side toward the toner ejection unit 13, wherein the spiral pattern may converge near the toner ejection unit 13, and the toner T (used as developer) is stored in the toner bottle 11. The toner bottle 11 is detachably attached to an one end of the toner ejection unit 13. When the toner T in the toner bottle 11 becomes substantially consumed, in particular empty, the toner bottle 11 is detached from the toner ejection unit 13, and a used toner bottle 11 is replaced by a new toner bottle 11 storing toner with a toner-full condition.

The toner bottle 11 is coupled with the toner forwarding unit 12 including a toner bottle motor 12*a*, a motor gear 12*b*, and a drive gear 12*c*, for example. A rotation shaft of the toner bottle motor 12*a* is linked to the motor gear 12*b* meshing with the drive gear 12*c*. The drive gear 12*c* can contact the toner bottle 11, by which the toner bottle 11 can be rotated by rotating the drive gear 12*c* using the toner bottle motor 12*a*. The drive gear 12*c* may directly contact the toner bottle 11, or may indirectly contact the toner bottle 11 via an intervening member. The toner bottle 11 is adapted to communicate with the toner ejection unit 13. When the toner bottle 11 is rotated by the toner forwarding unit 12 in a direction shown by arrow in FIG. 1, toner T in the toner bottle 11 can be moved or forwarded toward the toner ejection unit 13 with an effect of the spiral pattern formed on the toner bottle 11. As such, at least the toner forwarding unit 12 can be referred to as an intra-vessel transporting device to move or forward toner in the toner bottle 11.

The toner ejection unit 13 is coupled with the toner transport route 15, and the toner transport route 15 is connected to the sub-tank 16. The toner ejection unit 13 feeds the toner T, forwarded from the toner bottle 11 using the toner forwarding unit 12, to the toner transport route 15.

The toner ejection unit 13 may be attached with a toner IC (integrated circuit) chip 14*a* of the toner remaining amount memory/management unit 14. The toner remaining amount memory/management unit 14 may include the toner IC chip 14*a*, an antenna member 14*b* disposed near the toner IC chip 14*a*, and an antenna operation controller 14*c* to control operation of the antenna member 14*b*. Under a control of the antenna operation controller 14*c* of the toner remaining amount memory/management unit 14, a wireless communication is conducted between the antenna member 14*b* and the toner IC chip 14*a* to write toner amount remaining in the toner bottle 11 to the toner IC chip 14*a*. Further, under a control of the antenna operation controller 14*c*, a wireless communication is conducted between the antenna member 14*b* and the toner IC chip 14*a* to read out toner amount remaining in the toner bottle 11 stored in the toner IC chip 14*a*. As such, as for the toner supply unit 10, the controller 21 writes toner amount remaining in the toner bottle 11 to the toner IC chip 14*a* of the toner remaining amount memory/management unit 14, attached to the toner ejection unit 13 coupled to the toner bottle 11, at a given timing, and the controller 21 also reads out toner remaining amount written in the toner IC chip 14*a*, as required, to manage an amount of toner T remaining in the toner bottle 11. Further, each of the toner IC chip 14*a*, the antenna member 14*b*, and the antenna operation controller 14*c* may be mounted on a base, for example. As such, the toner remaining amount memory/management unit 14 may be used as an intra-vessel developer amount detector.

When toner amount management of toner amount remaining in the toner bottle 11 is conducted using the toner remaining amount memory/management unit 14, the controller 21 computes toner amount remaining in the toner bottle 11 based on rotation amount of the toner bottle motor 12*a* of the toner forwarding unit 12, in which the rotation amount of the toner bottle motor 12*a* is specified by a rotation speed and a rotation time of the toner bottle motor 12*a*. Under a control of the antenna operation controller 14*c* of the toner remaining amount memory/management unit 14, the computed toner remaining amount is written and stored in the toner IC chip 14*a* via the antenna member 14*b*, and further, under a control of the antenna operation controller 14*c*, toner remaining amount is read out from the toner IC chip 14*a* via the antenna member 14*b*, by which an management process of toner remaining amount in the toner bottle 11 is conducted.

Figure 2:
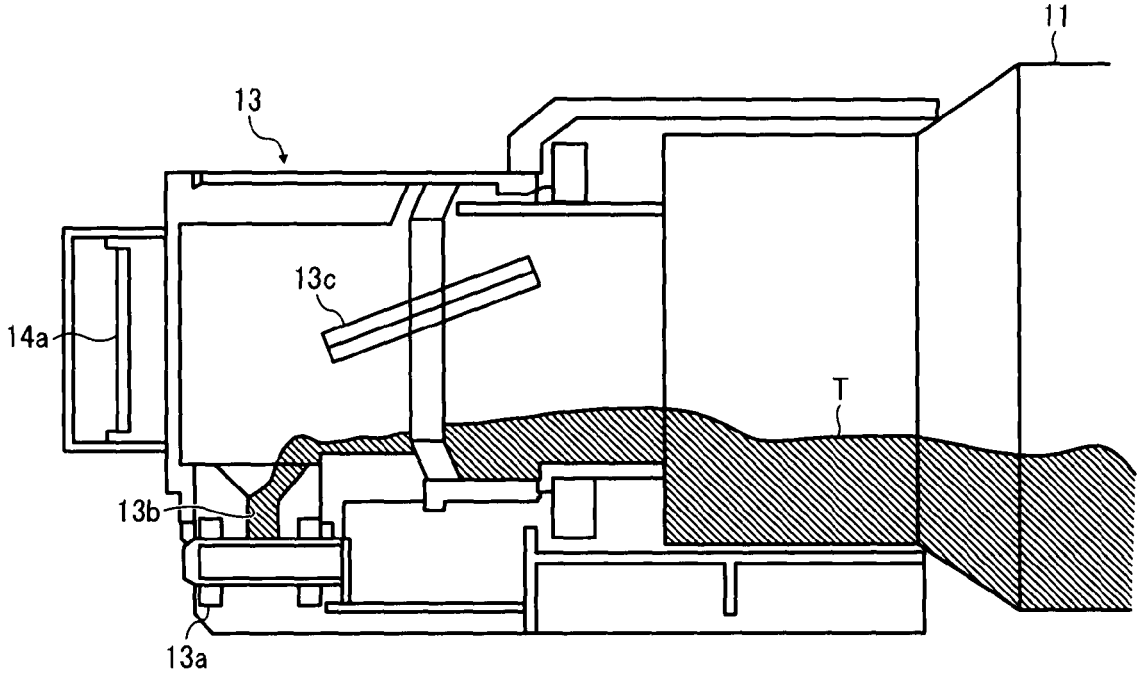
FIG. 2 shows an expanded cross-sectional view of toner ejection unit.

As shown in FIG. 2, the toner ejection unit 13 may include a coupling member 13*a* that couples with the toner transport route 15, an ejection port 13*b* that communicates with the coupling member 13*a*, and an adjustment valve 13*c*. The toner IC chip 14*a* may be attached on the toner ejection unit 13, for example.

The adjustment valve 13*c* guides the toner T, forwarded from the toner bottle 11, to the ejection port 13*b*, and adjusts an amount of toner T at a suitable level, and the ejection port 13*b* ejects the toner T forwarded from the toner bottle 11 to the coupling member 13*a* coupled with the toner transport route 15.

The sub-tank 16 (used as sub-supply container or sub-storage vessel) is provided with the mohno-pump 17 connected to the toner transport route 15. The mohno-pump 17 (used as a transport/supply device) may be a screw pump employing a one-axis eccentric screw for rotatable volume type. The mohno-pump 17 is used to move the toner T from the toner ejection unit 13 of the toner bottle 11 to the sub-tank 16 via the toner transport route 15.

The sub-tank 16 is provided with the toner transport motor 19 that is connected to the toner transport route 20 connected to the development unit GB. The toner transport motor 19 is used to supply the toner T in the sub-tank 16 to the development unit GB via the toner transport route 20.

The sub-tank 16 is provided with the toner-full sensor 18, which detects an amount of toner stored in the sub-tank 16 and outputs a detection result to the controller 21. As such, the toner-full sensor 18 may be used as an intermediate-developer amount detector which detects an amount of developer stored intermediary in the sub-tank 16. Specifically, the toner-full sensor 18 detects whether an amount of toner stored in the sub-tank 16 is greater than a toner-full condition and outputs a detection result to the controller 21, in which when toner is filled in the sub-tank 16 at a toner-full condition, the toner-full sensor 18 detects the toner-full condition, and when toner filled in the sub-tank 16 decreases from the toner-full condition, the toner-full sensor 18 does not detect the toner-full condition. As such, the toner-full sensor 18 can detect a toner level condition in the sub-tank 16.

The controller 21 (used as a control unit) may be connected to the antenna operation controller 14*c*, the toner-full sensor 18, the toner bottle motor 12*a*, the mohno-pump 17, and the toner transport motor 19, for example. When the toner transport motor 19 is activated and the toner T is supplied from the sub-tank 16 to the development unit GB, an amount of toner T in the sub-tank 16 decreases. When the toner-full sensor 18 does not detect the toner T in the sub-tank 16, the controller 21 controls a toner transport processing so that the toner T is supplied from the toner bottle 11 to the sub-tank 16 while managing toner amount remaining in the toner bottle 11 using the toner remaining amount memory/management unit 14 and controlling a driving of the toner forwarding unit 12 and the mohno-pump 17 as described later.

Further, although not shown, the controller 21 may include a central processing unit (CPU), a read only memory (ROM), and a random access memory (RAM), or the like. The ROM may store general programs used for the image forming apparatus 1, programs of toner transport processing, and various data required for executing such programs. The CPU uses the RAM as a working memory for programs stored in the ROM to control each unit in the image forming apparatus 1, by which the CPU conducts processing in the image forming apparatus 1, and conducts the toner transport processing for the toner supply unit 10 according to example embodiments.

In the image forming apparatus 1, toner transport program (used as program for transporting developer) is read out from a computer-readable storage media such as read only memory (ROM), electrically erasable and programmable read only memory (EEPROM), erasable programmable read only memory (EPROM), flash memory, flexible disk, compact disc read only memory (CD-ROM), compact disc rewritable (CD-RW), digital versatile disk (DVD), secure digital (SD) card, and magneto-optical disc (MO) or the like, and such program is loaded to RAM or the like to manage the toner T in the toner bottle 11 correctly, and to supply the toner T to the sub-tank 16 suitably using the toner supply unit 10, which is to be described later. Such toner transport program may be written by computer-executable program described by legacy programming language or object-oriented programming language such as Assembler, C, C++, C#, Java (registered trademark), and such program can be distributed by storing program in the above-described storage medium, can be distributed via a network.

A description is now given to a toner management process according to an example embodiment. In the image forming apparatus 1, by suitably conducting toner supply from the toner bottle 11 to the sub-tank 16 using the toner forwarding unit 12 and the mohno-pump 17, toner amount remaining in the toner supply unit 10 can be managed at a suitable level and the malfunction of the mohno-pump 17 can be prevented.

In the image forming apparatus 1, the development unit GB supplies toner onto an electrostatic latent image formed on a photoconductor to develop a toner image on the photoconductor, and the developed toner image is transferred and fixed on a transfer sheet to conduct an image forming operation. As image forming operations are being conducted in the image forming apparatus 1, the toner T in the development unit GB is consumed, and a toner detection sensor (not shown) detects an amount of toner in the development unit GB. Based on the detection result toner amount in the development unit GB, the controller 21 may control a driving of the toner transport motor 19 to refill the toner T into the development unit GB from the sub-tank 16 via the toner transport route 20.

As for the toner supply unit 10, when the development unit GB is supplied or refilled with the toner T from the sub-tank 16, an amount of toner T in the sub-tank 16 decreases, and the toner-full sensor 18 detects a decrease of toner T in the sub-tank 16 and outputs a signal indicating a decrease of toner T in the sub-tank 16 to the controller 21. Then, the controller 21 activates the toner forwarding unit 12 to rotate the toner bottle 11 at a given speed for a given time to forward the toner T in the toner bottle 11 toward the toner ejection unit 13, and then drives the toner forwarding unit 12 and the mohno-pump 17 to transport the toner T from the toner ejection unit 13 to the sub-tank 16 via the toner transport route 15, by which the toner transport processing can be conducted.

Figure 3A:
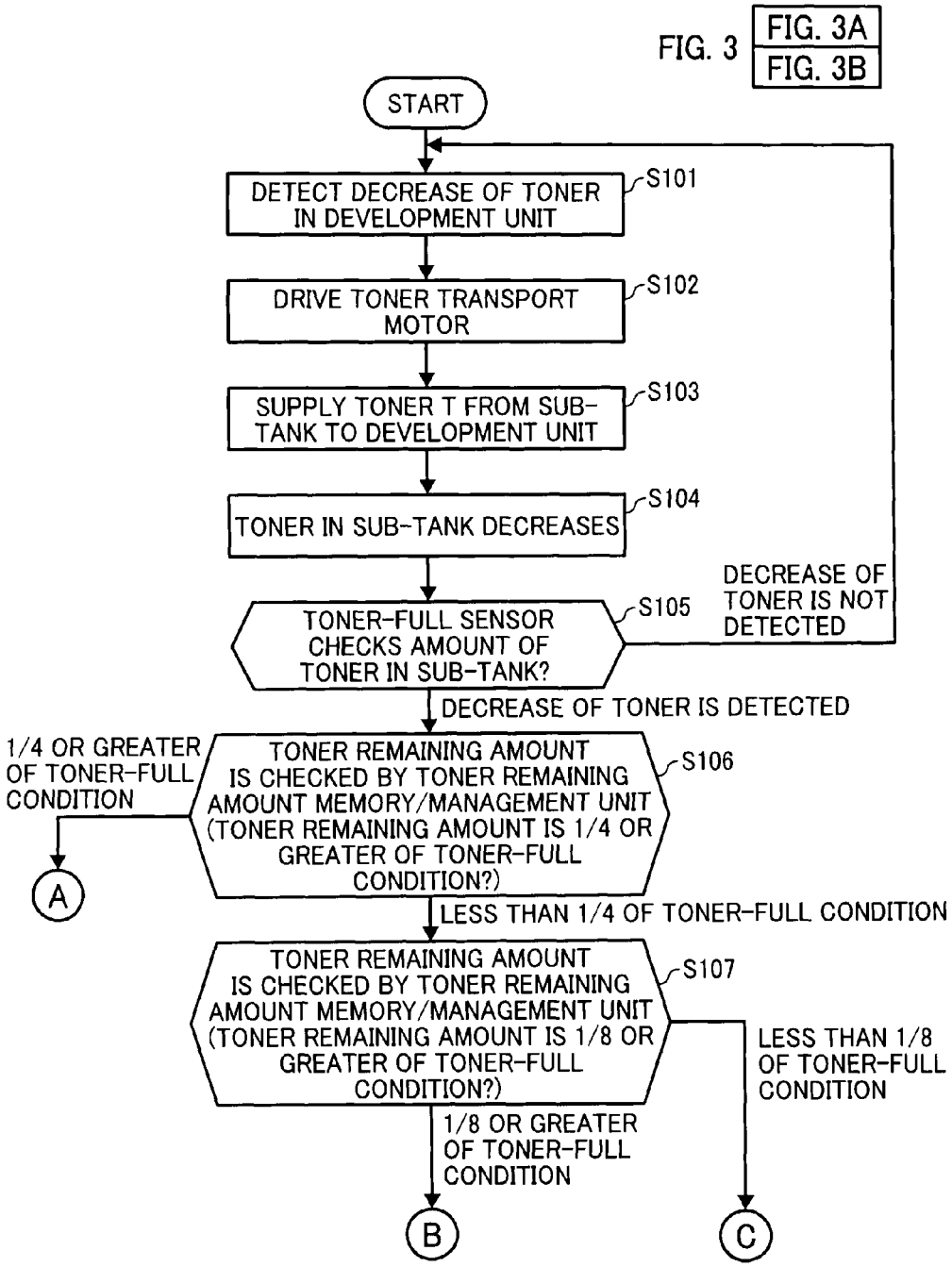
FIGS. 3A and 3B show a flowchart explaining toner transport processing by a toner supply unit according to a first example embodiment.
Figure 3B:
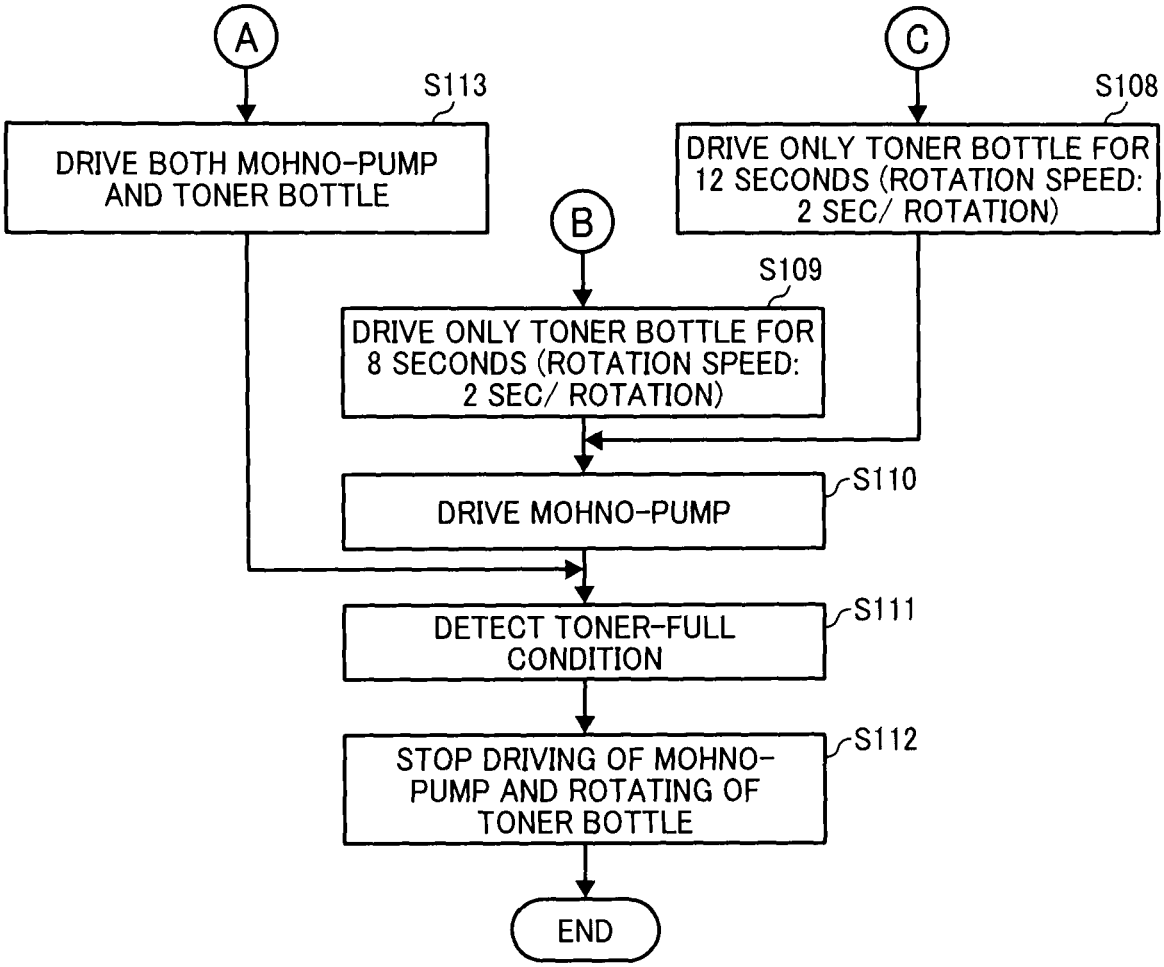

As shown in FIG. 3A, as for the toner supply unit 10, if a toner detection sensor detects a decrease of toner amount in the development unit GB (step S101), the controller 21 drives the toner transport motor 19 (step S102), and supplies the toner T from the sub-tank 16 to the development unit GB via the toner transport route 20 (step S103). By supplying toner from the sub-tank 16 to the development unit GB, an amount of toner T in the sub-tank 16 decreases (step S104), and the toner-full sensor 18 checks and confirms an amount of toner T in the sub-tank 16 (step S105).

If the toner-full sensor 18 does not detect a decrease of toner T in the sub-tank 16 at step S105, the controller 21 returns the process to step S101, and then conducts the above described processing similarly (steps S101 to S105).

If the toner-full sensor 18 detects a decrease of toner T in the sub-tank 16 at step S105, toner remaining amount in the toner bottle 11 is checked using the toner remaining amount memory/management unit 14*a* (step S106). Specifically, the controller 21 reads out information of toner amount remaining in the toner bottle 11, stored in the toner IC chip 14*a*, using the antenna member 14*b* via the antenna operation controller 14*c*, and then the controller 21 checks whether toner remaining amount is ¼ (one-fourth) or greater of toner-full condition.

If toner amount remaining in the toner bottle 11 is less than ¼ of toner-full condition at step S106, the controller 21 checks whether toner amount remaining in the toner bottle 11 is ⅛ (one-eighth) or greater of toner-full condition (step S107).

If toner amount remaining in the toner bottle 11 is less than ⅛ of toner-full condition at step S107, the toner bottle motor 12*a* is driven for 12 seconds (12 sec), in which the toner bottle 11 is alone rotated at a given speed such as for example 2 seconds per rotation (2 sec/rotation) by the toner forwarding unit 12 to forward the toner T in the toner bottle 11 to the toner ejection unit 13 (step S108).

If toner amount remaining in the toner bottle 11 is ⅛ or greater of toner-full condition at step S107, the toner bottle motor 12*a* is alone driven and rotated for a given forwarding time such as for example 8 seconds (8 sec), in which the toner bottle 11 is alone rotated at a given speed such as for example 2 seconds per rotation (2 sec/rotation) by the toner forwarding unit 12 to forward the toner T in the toner bottle 11 to the toner ejection unit 13 (step S109).

When the toner T in the toner bottle 11 is forwarded toward the toner ejection unit 13 by the toner forwarding unit 12 as such, the controller 21 then drives the mohno-pump 17 while forwarding the toner T using the toner forwarding unit 12 (step S110), and if the toner-full sensor 18 detects a toner-full condition (step S111), the controller 21 stops a driving of the mohno-pump 17 and a rotating of the toner bottle 11 by the toner forwarding unit 12 (step S112).

If the toner remaining amount memory/management unit 14 confirms toner amount remaining in the toner bottle 11 is ¼ or greater of toner-full condition at step S106, the controller 21 drives both of the mohno-pump 17 and the toner forwarding unit 12 simultaneously to concurrently conduct a forwarding of the toner T in the toner bottle 11 to the toner ejection unit 13 using the toner forwarding unit 12, and a transportation of the toner T to the sub-tank 16 using the mohno-pump 17 (step S113). Then, if the toner-full sensor 18 detects a toner-full condition (step S111), the controller 21 stops a driving of the mohno-pump 17 and a rotating of the toner bottle 11 by the toner forwarding unit 12 (step S112).

As for the toner supply unit 10 according to the first example embodiment, the controller 21 may conduct a management of toner amount remaining in the toner bottle 11 based on a rotation amount of the toner bottle 11 using the toner remaining amount memory/management unit 14.

If toner amount remaining in the toner bottle 11 is less than ¼, a process of forwarding the toner T in the toner bottle 11 to the toner ejection unit 13 is conducted by rotating the toner bottle 11 alone using the toner forwarding unit 12 before driving the mohno-pump 17, in which the toner bottle 11 is alone rotated but the mohno-pump 17 is not driven, and a transportation of the toner T from the toner bottle 11 to the sub-tank 16 is not yet conducted. Therefore, the controller 21 computes toner amount remaining in the toner bottle 11 using a time, which is obtained by subtracting a time period that the mohno-pump 17 is not driven from an actual rotation time of the toner bottle 11. In other words, the controller 21 computes toner amount remaining in the toner bottle 11 using an actual rotation time of the mohno-pump 17.

As such, as for the toner supply unit 10 of image forming apparatus 1 according to the first example embodiment, the toner T, used as developer and stored in the toner bottle 11 detachably attached to an one end of the toner ejection unit 13, can be transported from the toner ejection unit 13 to the sub-tank 16 using the mohno-pump 17 when the toner T is supplied or refilled from the sub-tank 16 to the development unit GB. In such a configuration, if the toner-full sensor 18, which is used to detect an amount of toner in the sub-tank 16, detects that the amount of toner T in the sub-tank 16 becomes a certain amount or less, the toner forwarding unit 12 is driven for a given time to forward the toner T in the toner bottle 11 to the toner ejection unit 13, and after then, the mohno-pump 17 is driven along with the toner forwarding unit 12. Then, when the toner-full sensor 18 detects that the sub-tank 16 is refilled with the toner T with a certain amount, driving of the toner forwarding unit 12 and mohno-pump 17 is stopped.

If the mohno-pump 17 is driven while the toner T does not substantially exist in the toner ejection unit 13 detachably attached to the toner bottle 11, air leak may occur to the mohno-pump 17, by which the mohno-pump 17 may malfunction and toner transportation malfunction may occur.

Accordingly, with an employment of the above-described configuration of first example embodiment, such mohno-pump malfunction and toner transportation malfunction can be prevented, and toner can be preferably transported from the toner ejection unit 13 to the sub-tank 16, and an amount of toner in the toner bottle 11 can be managed appropriately.

Further, in the image forming apparatus 1 according to the first example embodiment, when the controller 21 of the toner supply unit 10 activates the toner forwarding unit 12 to rotate the toner bottle 11 alone to forward the toner T in the toner bottle 11 to nearby of the toner ejection unit 13, the mohno-pump 17 is not yet driven. The controller 21 does not count or include a time when the mohno-pump 17 is not driven as a toner ejecting time, but only count a time when the mohno-pump 17 is driven as a toner transporting time, and such time information may be stored in the toner remaining amount memory/management unit 14. With such a configuration, toner remaining amount in the toner bottle 11 can be computed at a condition which is close to an actual toner transport operation, by which a management of toner remaining amount can be conducted more correctly.

Further, in the above described configuration, a current toner amount remaining in the toner bottle 11 can be computed based on a last known amount of toner amount remaining in the toner bottle 11 and a driving time of the mohno-pump 17, by which toner amount remaining in the toner bottle 11 can be computed more correctly. Such last known amount of toner amount remaining in the toner bottle 11 may be obtained or detected at steps S106 and S107, for example, because, at steps S106 and S107, toner amount remaining in the toner bottle 11 before conducting a toner transportation operation is checked as above described, and such current toner amount remaining in the toner bottle 11 is a toner amount remaining in the toner bottle 11 after conducting a toner transportation operation.

Because a toner ejection amount from the toner bottle 11 decreases as an amount of toner in the toner bottle 11 decreases, by considering a decrease of toner ejection amount from the toner bottle 11 in response to a decrease of toner amount remaining in the toner bottle 11, an amount of toner remaining in the toner bottle 11 can be computed more correctly, by which an error between an actual toner amount remaining in the toner bottle 11 and a toner remaining amount managed by the toner remaining amount memory/management unit 14 can be reduced.

Figure 4A:
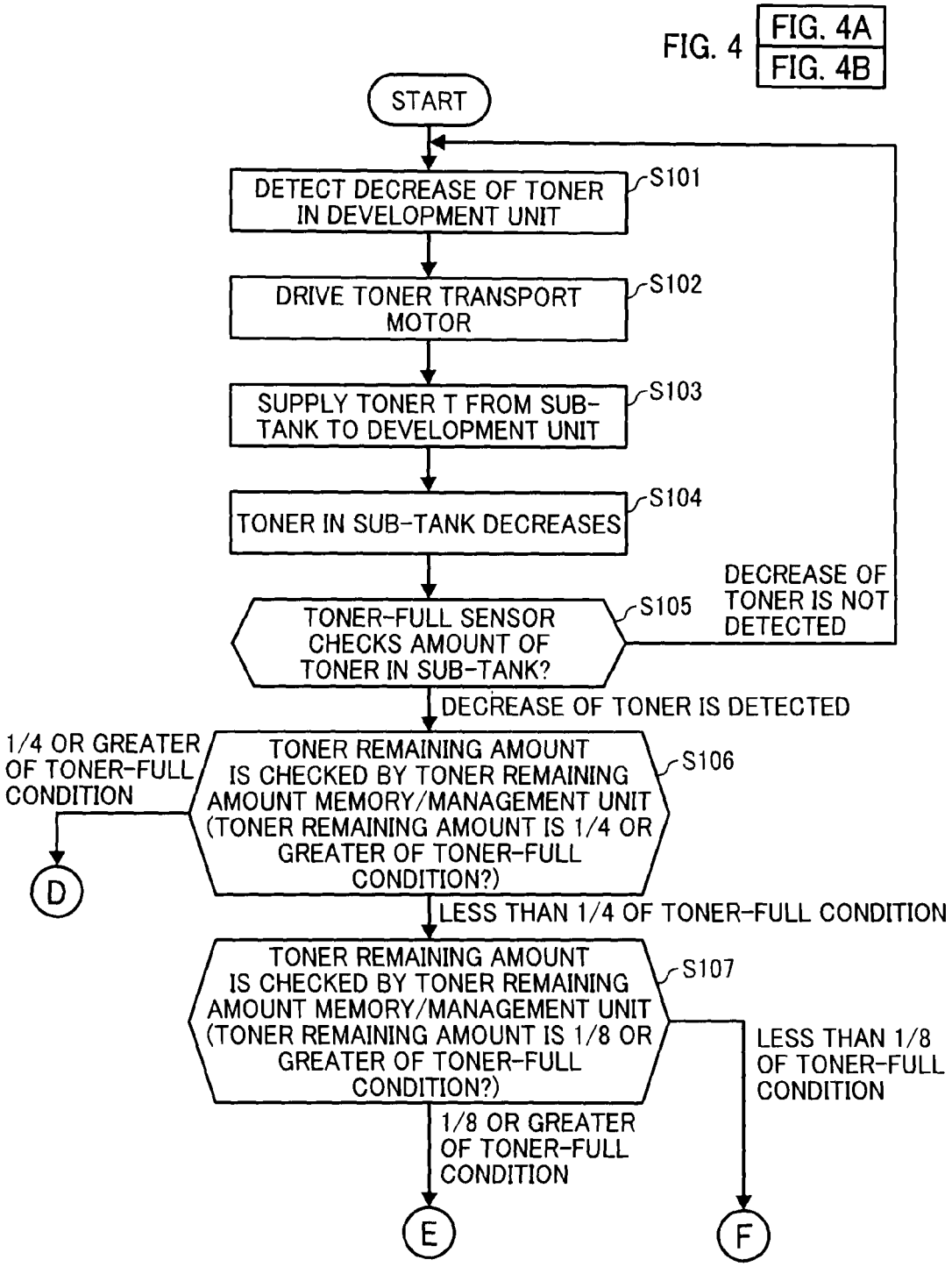
FIGS. 4A and 4B show another flowchart explaining toner transport processing by a toner supply unit, in which a toner forwarding speed is changeable depending on an amount of toner remaining in a toner bottle.
Figure 4B:
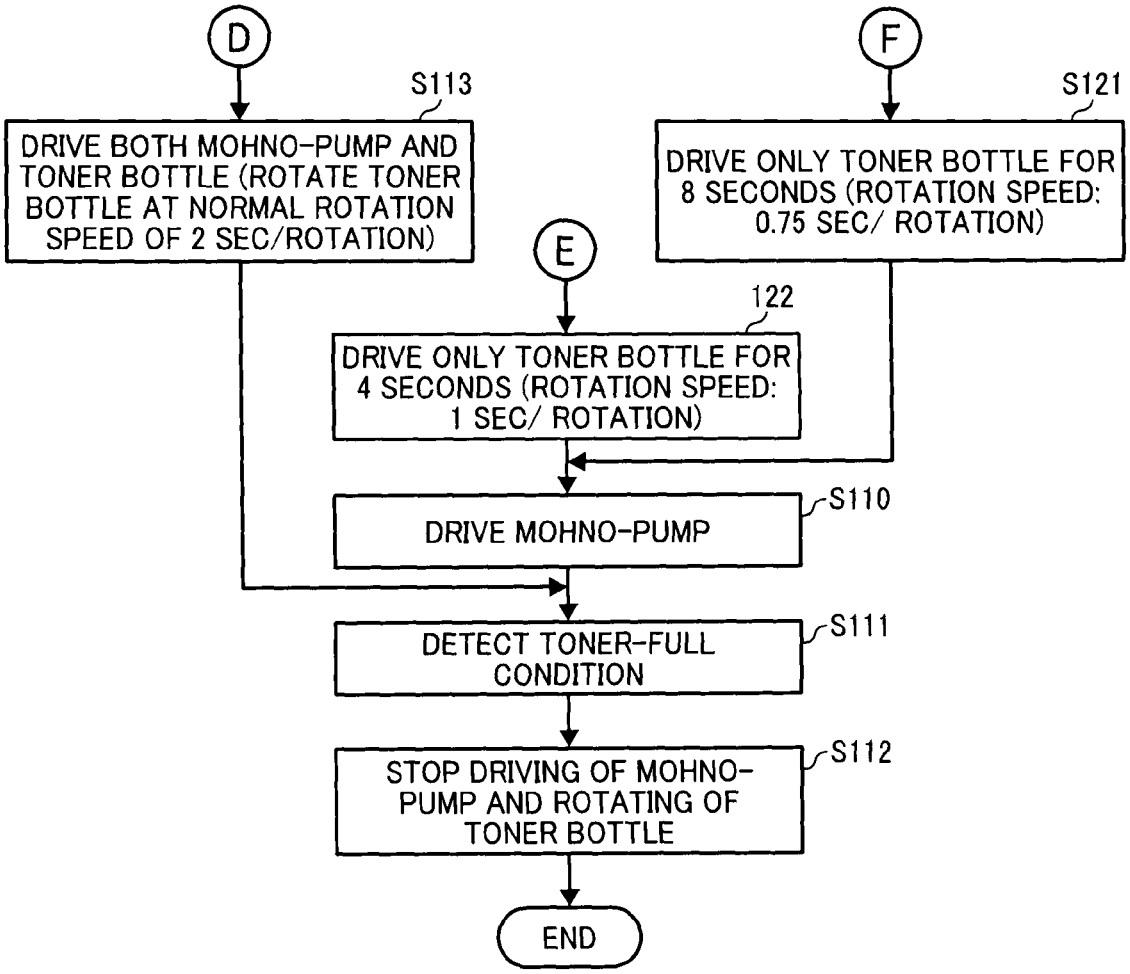

Further, in the above described toner transport processing, a forwarding speed by the toner forwarding unit 12 can be changed depending on the toner amount remaining in the toner bottle 11 as shown in FIGS. 4A/4B. In FIGS. 4A/4B, same step numbers are attached to same process steps shown in FIGS. 3A/3B, and the explanation for such steps is simplified or omitted.

As shown in FIGS. 4A/4B, if a toner detection sensor detects a decrease of toner in the development unit GB (step S101), the controller 21 drives the toner transport motor 19 (step S102), and supplies the toner T from the sub-tank 16 to the development unit GB via the toner transport route 20 (step S103). By supplying toner from the sub-tank 16 to the development unit GB, an amount of toner T in the sub-tank 16 decreases (step S104), and an amount of toner T in the sub-tank 16 is confirmed by the toner-full sensor 18 (step S105).

If the toner-full sensor 18 detects a decrease of toner T at step S105, the controller 21 reads out information from the toner IC chip 14*a* of the toner remaining amount memory/management unit 14 to confirm toner remaining amount in the toner bottle 11 (step S106). If toner amount remaining in the toner bottle 11 is less than ¼ of toner-full condition at step S106, it is checked whether toner amount remaining in the toner bottle 11 is ⅛ or greater of toner-full condition (step S107).

If toner amount remaining in the toner bottle 11 is less than ⅛ of toner-full condition at step S107, the toner bottle motor 12*a* is driven and rotated for a given forwarding time such as for example 8 seconds (8 sec) at a speed such as for example 0.75 sec/rotation, which is faster than the normal rotation speed such as for example 2 sec/rotation for more than two times. As such, the toner T in the toner bottle 11 is forwarded toward the toner ejection unit 13 (step S121) by rotating the toner bottle 11 at the speed of 0.75 sec/rotation, faster than the normal rotation speed such as 2 sec/rotation for more than two times, by using the toner forwarding unit 12.

If toner amount remaining in the toner bottle 11 is ⅛ or greater of toner-full condition at step S107, the toner bottle motor 12*a* is driven and rotated for a given forwarding time such as for example 4 seconds (4 sec) at a speed such as for example 1 sec/rotation, which is faster than the normal rotation speed such as for example 2 sec/rotation for two times. As such the toner T in the toner bottle 11 is forwarded toward the toner ejection unit 13 by rotating the toner bottle 11 at the speed of 1 sec/rotation, faster than the normal rotation speed such as 2 sec/rotation for two times, by using the toner forwarding unit 12 (step S122).

When the toner T in the toner bottle 11 is forwarded toward the toner ejection unit 13 by the toner forwarding unit 12 for the above described forwarding time, the controller 21 then drives the mohno-pump 17 while forwarding the toner T using the toner forwarding unit 12 (step S110), and if the toner-full sensor 18 detects a toner-full condition (step S111), the controller 21 stops a driving of the mohno-pump 17 and a rotating of the toner bottle 11 by the toner forwarding unit 12 (step S112).

If the toner remaining amount memory/management unit 14 confirms toner amount remaining in the toner bottle 11 is ¼ or greater of toner-full condition at step S106, the controller 21 drives both of the mohno-pump 17 and the toner forwarding unit 12 simultaneously to concurrently conduct a forwarding of the toner T in the toner bottle 11 to the toner ejection unit 13 using the toner forwarding unit 12 and a transportation of the toner T to the sub-tank 16 using the mohno-pump 17 (step S113), in which the controller 21 drives and rotates the toner bottle motor 12*a* at the normal rotation speed such as for example 2 sec/rotation, and by rotating the toner bottle 11 at the normal rotation speed such as 2 sec/rotation by the toner forwarding unit 12, the toner T in the toner bottle 11 is forwarded toward the toner ejection unit 13.

Then, if the toner-full sensor 18 detects a toner-full condition (step S111), the controller 21 stops a driving of the mohno-pump 17 and a rotating of the toner bottle 11 by the toner forwarding unit 12 (step S112).

As above described, the toner remaining amount memory/management unit 14 can obtain an amount of toner in the toner bottle 11. When the forwarding speed of toner T by the toner forwarding unit 12 is controlled depending on an amount of toner in the toner bottle 11 detected (or obtained) by the toner remaining amount memory/management unit 14, the toner T in the toner bottle 11 can be forwarded or moved toward the toner ejection unit 13 with a shorter time, by which a time duration between a start of toner transportation driving and a start of supplying toner to the sub-tank 16 can be reduced. As a result, after forwarding the toner T to nearby of the toner ejection unit 13, the mohno-pump 17 can be driven, by which degradation and/or damage occurrence to the mohno-pump 17 can be prevented more effectively.

Figure 5:
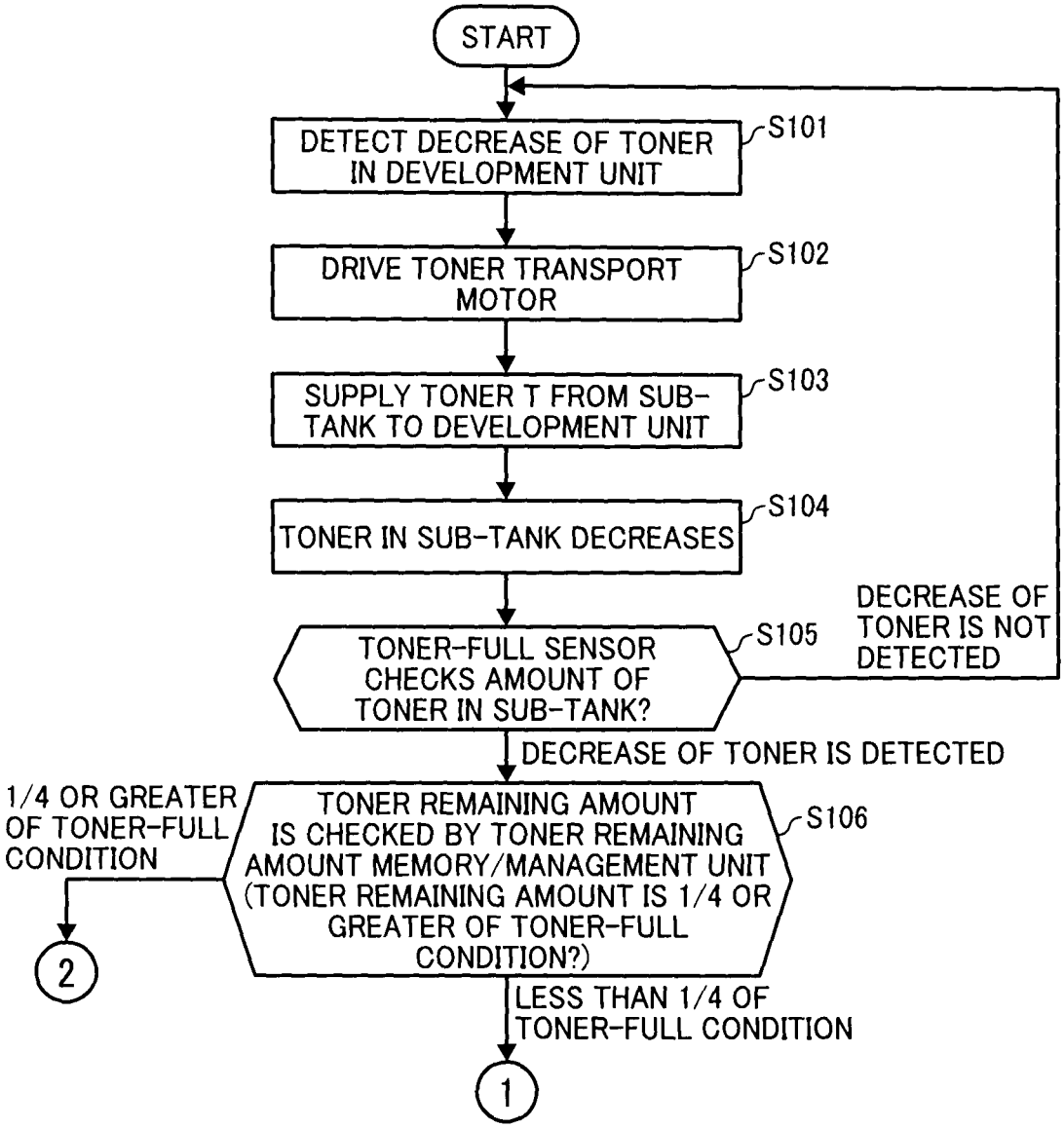
FIG. 5 shows another flowchart explaining toner transport processing by a toner supply unit, in which a driving speed of mohno-pump is changeable depending on an amount of toner remaining in a toner bottle.
Figure 6:
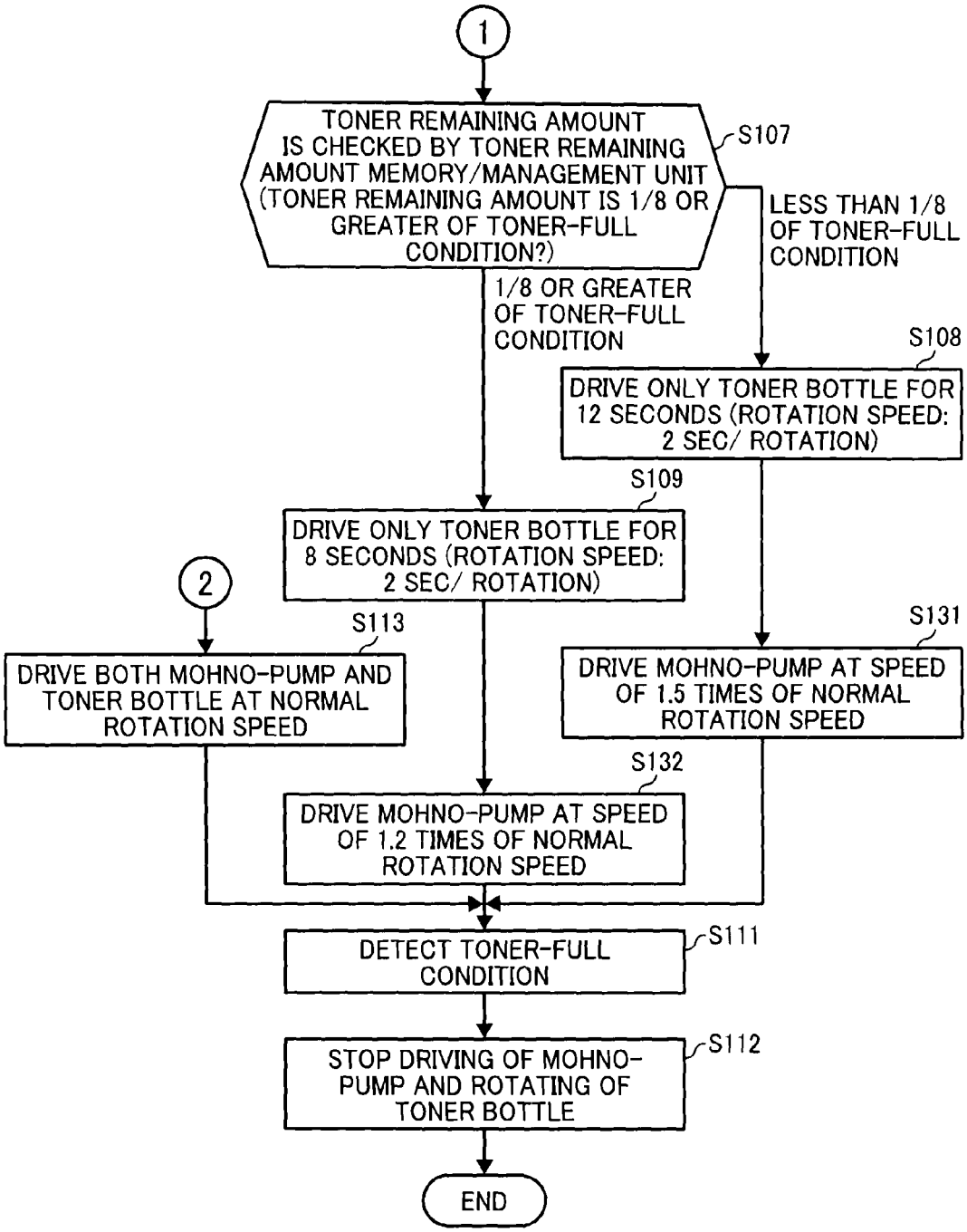
FIG. 6 shows a flowchart of continuation of FIG. 5.

Further, in the above-described toner transport processing, a driving speed of the mohno-pump 17 can be changed depending on toner amount remaining in the toner bottle 11 as shown in FIGS. 5 and 6. In FIGS. 5 and 6, same step numbers are attached to same process steps shown in FIGS. 3A/3B, and the explanation for such steps is simplified or omitted.

As shown in FIG. 5, if a toner detection sensor detects a decrease of toner in the development unit GB (step S101), the controller 21 drives the toner transport motor 19 (step S102), and supplies the toner T from the sub-tank 16 to the development unit GB via the toner transport route 20 (step S103). By supplying toner from the sub-tank 16 to the development unit GB, an amount of toner T in the sub-tank 16 decreases (step S104), and an amount of toner T in the sub-tank 16 is confirmed by the toner-full sensor 18 (step S105).

If the toner-full sensor 18 detects a decrease of toner T in the sub-tank 16 at step S105, the controller 21 reads out information from the toner IC chip 14*a* of the toner remaining amount memory/management unit 14 to confirm toner remaining amount in the toner bottle 11 (step S106). If toner amount remaining in the toner bottle 11 is less than ¼ of toner-full condition at step S106, as shown in FIG. 6, it is checked whether toner amount remaining in the toner bottle 11 is ⅛ or greater of toner-full condition (step S107).

If toner amount remaining in the toner bottle 11 is less than ⅛ of toner-full condition at step S107, the toner bottle motor 12*a* is alone driven and rotated for a given forwarding time such as for example 12 seconds (12 sec), in which the toner bottle 11 is alone rotated at a given speed such as for example 2 seconds per rotation (2 sec/rotation) by using the toner forwarding unit 12 to forward the toner T in the toner bottle 11 to the toner ejection unit 13 (step S108). Then, while forwarding the toner T using the toner forwarding unit 12, the mohno-pump 17 is driven at a speed faster than the normal rotation speed for 1.5 times, for example, to start transportation of toner from the toner ejection unit 13 to the sub-tank 16 (step S131).

If toner amount remaining in the toner bottle 11 is ⅛ or greater of toner-full condition at step S107, the toner bottle motor 12*a* is alone driven and rotated for a given forwarding time such as for example 8 seconds (8 sec), in which the toner bottle 11 is alone rotated at a given speed such as for example 2 seconds per rotation (2 sec/rotation) by using the toner forwarding unit 12 to forward the toner T in the toner bottle 11 to the toner ejection unit 13 (step S109). Then, while forwarding the toner T using the toner forwarding unit 12, the mohno-pump 17 is driven at a speed faster than the normal rotation speed for 1.2 times, for example, to start transportation of toner from the toner ejection unit 13 to the sub-tank 16 (step S132).

At step S132, while forwarding the toner T in the toner bottle 11 to the toner ejection unit 13 using the toner forwarding unit 12, the controller 21 drives the mohno-pump 17 to transport the toner T from the toner ejection unit 13 to the sub-tank 16. If the toner-full sensor 18 detects a toner-full condition (step S111), the controller 21 stops a driving of the mohno-pump 17 and a rotating of the toner bottle 11 by the toner forwarding unit 12 (step S112).

If the toner remaining amount memory/management unit 14 confirms toner amount remaining in the toner bottle 11 is ¼ or greater of toner-full condition at step S106 in FIG. 5, the controller 21 drives both of the mohno-pump 17 and toner forwarding unit 12 simultaneously at the normal rotation speed to concurrently conduct a forwarding of the toner T in the toner bottle 11 to the toner ejection unit 13 using the toner forwarding unit 12 and a transportation of the toner T to the sub-tank 16 using the mohno-pump 17 (step S113). If the toner-full sensor 18 detects a toner-full condition (step S111), the controller 21 stops a driving of the mohno-pump 17 and a rotating of the toner bottle 11 by the toner forwarding unit 12 (step S112).

When an amount of toner in the toner bottle 11 decreases, toner ejection amount of the toner T, eject-able from the toner bottle 11 to the sub-tank 16 via the toner ejection unit 13 and the mohno-pump 17 may decrease. However, if a driving speed of mohno-pump 17 is variably changed depending on toner amount remaining in the toner bottle 11, such decrease of toner ejection amount of the toner T eject-able from the toner bottle 11 to the sub-tank 16 can be prevented, by which a time required for storing the toner T in the sub-tank 16 when toner amount in the toner bottle 11 decreases can be set to a substantially same level when toner amount in the toner bottle 11 is at a toner-full condition.

Further, in the above described toner transport processing, the controller 21 can change the forwarding speed of the toner forwarding unit 12 and also a driving speed of the mohno-pump 17 depending on a toner amount remaining in the toner bottle 11. In such a case, the controller 21 can combine the toner transport processing shown in FIGS. 4A/4B and the toner transport processing shown in FIGS. 5 and 6, and can execute the combined toner transport processing.

Figure 7:
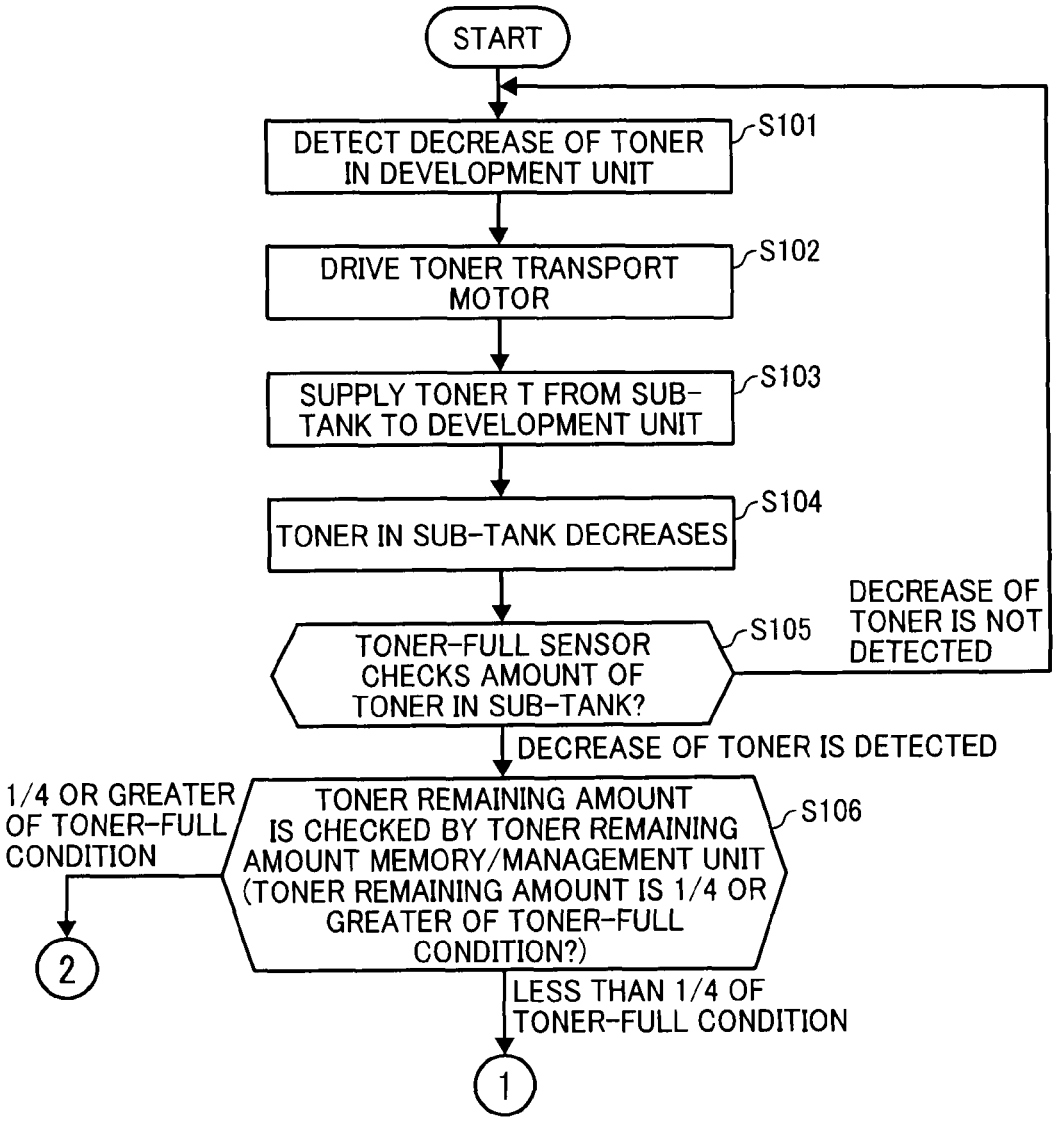
FIG. 7 shows a flowchart explaining toner transport processing by a toner supply unit, in which an amount of toner remaining in a toner bottle is managed based on rotation amount of a mohno-pump.
Figure 8:
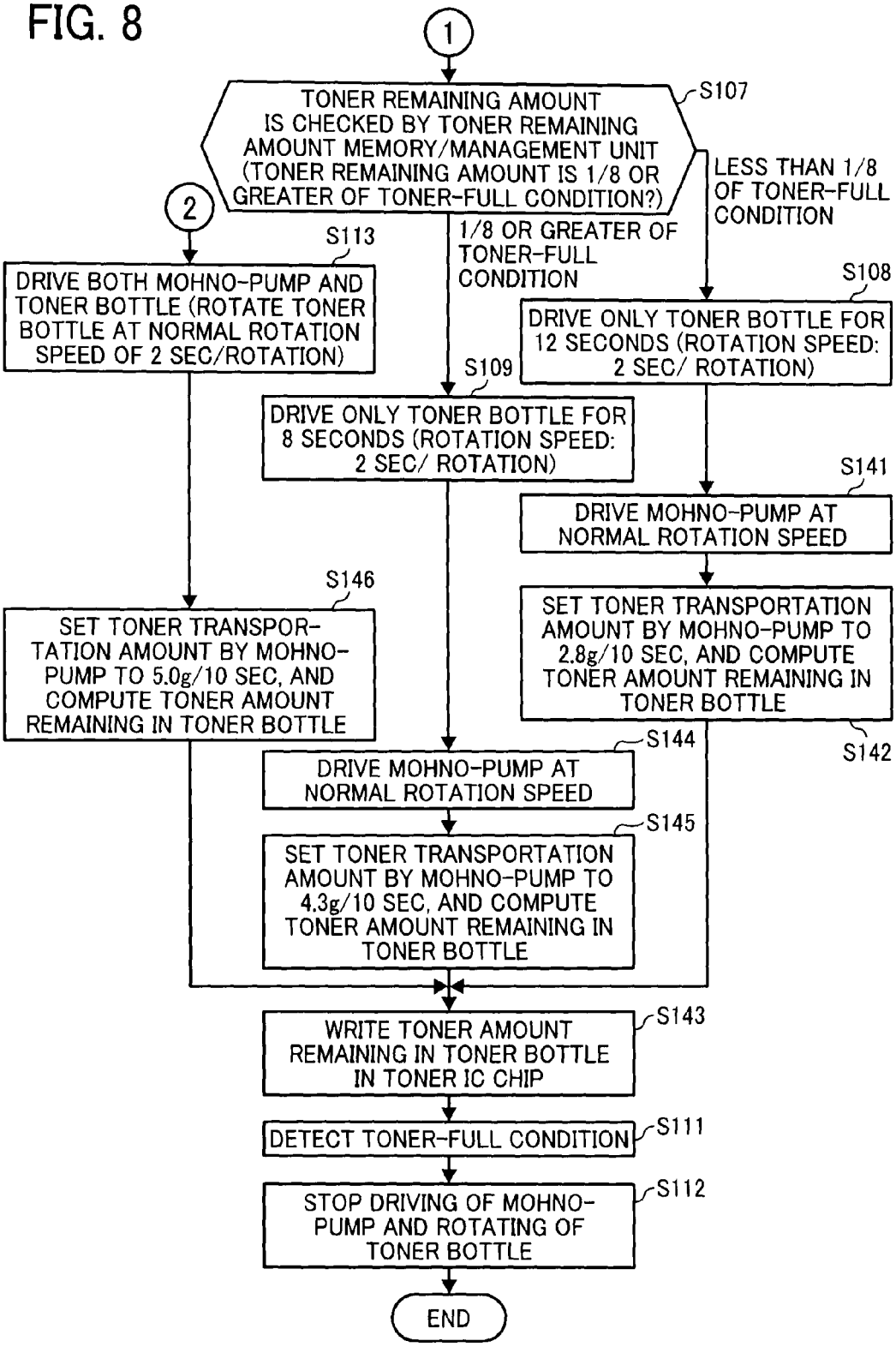
FIG. 8 shows a flowchart of continuation of FIG. 7.

Further, as for the toner supply unit 10 according to the first example embodiment, toner amount remaining in the toner bottle 11 can be computed based on a rotation amount of the toner bottle motor 12*a* of the toner forwarding unit 12 (i.e., a rotation amount of the toner bottle 11), and the toner amount remaining in the toner bottle 11 is managed by writing and reading out the computed toner remaining amount for the toner IC chip 14*a*. However, a management of the toner amount remaining in the toner bottle 11 is not limited to using a rotation amount of the toner bottle motor 12*a* (i.e., a rotation amount of the toner bottle 11), but other methods can be used as shown in FIGS. 7 and 8, for example, in which a management of the toner amount remaining in the toner bottle 11 is conducted based on a rotation amount of the mohno-pump 17. In FIGS. 7 and 8, same step numbers are attached to same process steps shown in FIGS. 3A/3B, and the explanation for such steps is simplified or omitted.

As shown in FIG. 7, if a toner detection sensor detects a decrease of toner amount in the development unit GB (step S101), the controller 21 drives the toner transport motor 19 (step S102), and supplies the toner T from the sub-tank 16 to the development unit GB via the toner transport route 20 (step S103). By supplying toner from the sub-tank 16 to the development unit GB, an amount of toner T in the sub-tank 16 decreases (step S104), and an amount of toner T in the sub-tank 16 is confirmed by the toner-full sensor 18 (step S105).

If the toner-full sensor 18 detects a decrease of toner T at step S105, the controller 21 reads out information from the toner IC chip 14*a* of the toner remaining amount memory/management unit 14 to confirm toner remaining amount in the toner bottle 11 (step S106). If toner amount remaining in the toner bottle 11 is less than ¼ of toner-full condition, as shown in FIG. 8, the controller 21 checks whether toner amount remaining in the toner bottle 11 is ⅛ or greater of toner-full condition using the toner remaining amount memory/management unit 14 (step S107).

If toner amount remaining in the toner bottle 11 is less than ⅛ of toner-full condition at step S107, the toner bottle motor 12*a* is driven for 12 seconds (12 sec), for example, in which the toner bottle 11 is alone rotated at a given speed such as for example 2 seconds per rotation (2 sec/rotation) by using the toner forwarding unit 12 to forward the toner T in the toner bottle 11 to the toner ejection unit 13 (step S108). Then, while forwarding the toner T using the toner forwarding unit 12, the controller 21 drives the mohno-pump 17 at the normal rotation speed to transport toner from the toner ejection unit 13 to the sub-tank 16 (step S141), in which the controller 21 may set a toner transport amount per predetermined unit of time by the mohno-pump 17 to 2.8 gram per 10 seconds (2.8 g/10 sec), for example, for toner transportation by the mohno-pump 17, in which when the mohno-pump 17 is driven for 10 seconds, 2.8 gram of toner can be transported from the toner ejection unit 13 to the sub-tank 16 by the mohno-pump 17 via the toner transport route 15, and such value may be used to compute toner amount remaining in the toner bottle 11. Specifically, the controller 21 computes toner amount remaining in the toner bottle 11 based on driving time duration of the mohno-pump 17 and the above described toner transport amount per predetermined unit of time (step S142). Then, under a control of the antenna operation controller 14*c* of the toner remaining amount memory/management unit 14, the computed toner amount remaining in the toner bottle 11 is written and stored in the toner IC chip 14*a* via the antenna member 14*b* (step S143).

Then, if the toner-full sensor 18 detects a toner-full condition (step S111), the controller 21 stops a driving of the mohno-pump 17 and a rotating of the toner bottle 11 by the toner forwarding unit 12 (step S112).

If toner amount remaining in the toner bottle 11 is ⅛ or greater of toner-full condition at step S107, the toner bottle motor 12*a* is alone driven and rotated for a given forwarding time such as for example 8 seconds (8 sec), in which the toner bottle 11 is alone rotated at a given speed such as for example 2 seconds per rotation (2 sec/rotation) by the toner forwarding unit 12 to forward the toner T in the toner bottle 11 to the toner ejection unit 13 (step S109). Then, while forwarding the toner T using the toner forwarding unit 12, the controller 21 drives the mohno-pump 17 at the normal rotation speed to transport toner from the toner ejection unit 13 to the sub-tank 16 (step S144).

If toner amount remaining in the toner bottle 11 is ⅛ or greater of toner-full condition at step S107, toner transport amount per predetermined unit of time by the mohno-pump 17 may become greater. In such a condition, the controller 21 may set toner transport amount per predetermined unit of time by the mohno-pump 17 to 4.3 gram per 10 seconds, for example, in which when the mohno-pump 17 is driven for 10 seconds, 4.3 gram of toner can be transported from the toner ejection unit 13 to the sub-tank 16 by the mohno-pump 17 via the toner transport route 15, and such value may be used to compute toner amount remaining in the toner bottle 11. Specifically, the controller 21 computes toner amount remaining in the toner bottle 11 based on driving time duration of the mohno-pump 17 and the above-described toner transport amount per predetermined unit of time (step S145). Then, under a control of the antenna operation controller 14*c* of the toner remaining amount memory/management unit 14, the computed toner amount remaining in the toner bottle 11 is written and stored in the toner IC chip 14*a* via the antenna member 14*b* (step S143).

Then, while forwarding the toner T in the toner bottle 11 to the toner ejection unit 13 using the toner forwarding unit 12, the controller 21 drives the mohno-pump 17 to transport toner from the toner ejection unit 13 to the sub-tank 16, and if the toner-full sensor 18 detects a toner-full condition (step S111), the controller 21 stops a driving of the mohno-pump 17 and a rotating of the toner bottle 11 by the toner forwarding unit 12 (step S112).

If the toner remaining amount memory/management unit 14 confirms toner amount remaining in the toner bottle 11 is ¼ or greater of toner-full condition at step S106 of FIG. 7, the controller 21 drives and rotates both of the mohno-pump 17 and the toner forwarding unit 12 simultaneously at the normal rotation speed to concurrently conduct a forwarding of the toner T in the toner bottle 11 to the toner ejection unit 13 using the toner forwarding unit 12 and a transportation of the toner T to the sub-tank 16 using the mohno-pump 17 (step S113).

If toner amount remaining in the toner bottle 11 is ¼ or greater of toner-full condition at step S107, toner transport amount per predetermined unit of time by the mohno-pump 17 may become greater. In such a condition, the controller 21 may set toner transport amount per predetermined unit of time by the mohno-pump 17 to 5.0 gram/10 seconds, for example, in which when the mohno-pump 17 is driven for 10 seconds, 5.0 gram of toner can be transported from the toner ejection unit 13 to the sub-tank 16 by the mohno-pump 17 via the toner transport route 15, and such value may be used to compute toner amount remaining in the toner bottle 11. Specifically, the controller 21 computes toner amount remaining in the toner bottle 11 based on driving time duration of the mohno-pump 17 and the above-described toner transport amount per predetermined unit of time (step S146). Then, under a control of the antenna operation controller 14*c* of the toner remaining amount memory/management unit 14, the computed toner amount remaining in the toner bottle 11 is written and stored in the toner IC chip 14*a* via the antenna member 14*b* (step S143).

If the toner-full sensor 18 detects a toner-full condition (step S111), the controller 21 stops a driving of the mohno-pump 17 and a rotating of the toner bottle 11 by the toner forwarding unit 12 (step S112).

As such, if toner amount remaining in the toner bottle 11 can be computed based on a rotation amount of the mohno-pump 17 as above described, a toner amount remaining in the toner bottle 11 can be computed more correctly, by which a management of toner amount remaining in the toner bottle 11 can be conducted more correctly.

In the above described example embodiment, a certain amount of toner and/or a certain speed may be used to determine a condition of toner transport processing, but it should be noted such values are just example values, and other values can be applied as required.

(Second Example Embodiment)

Figure 9:
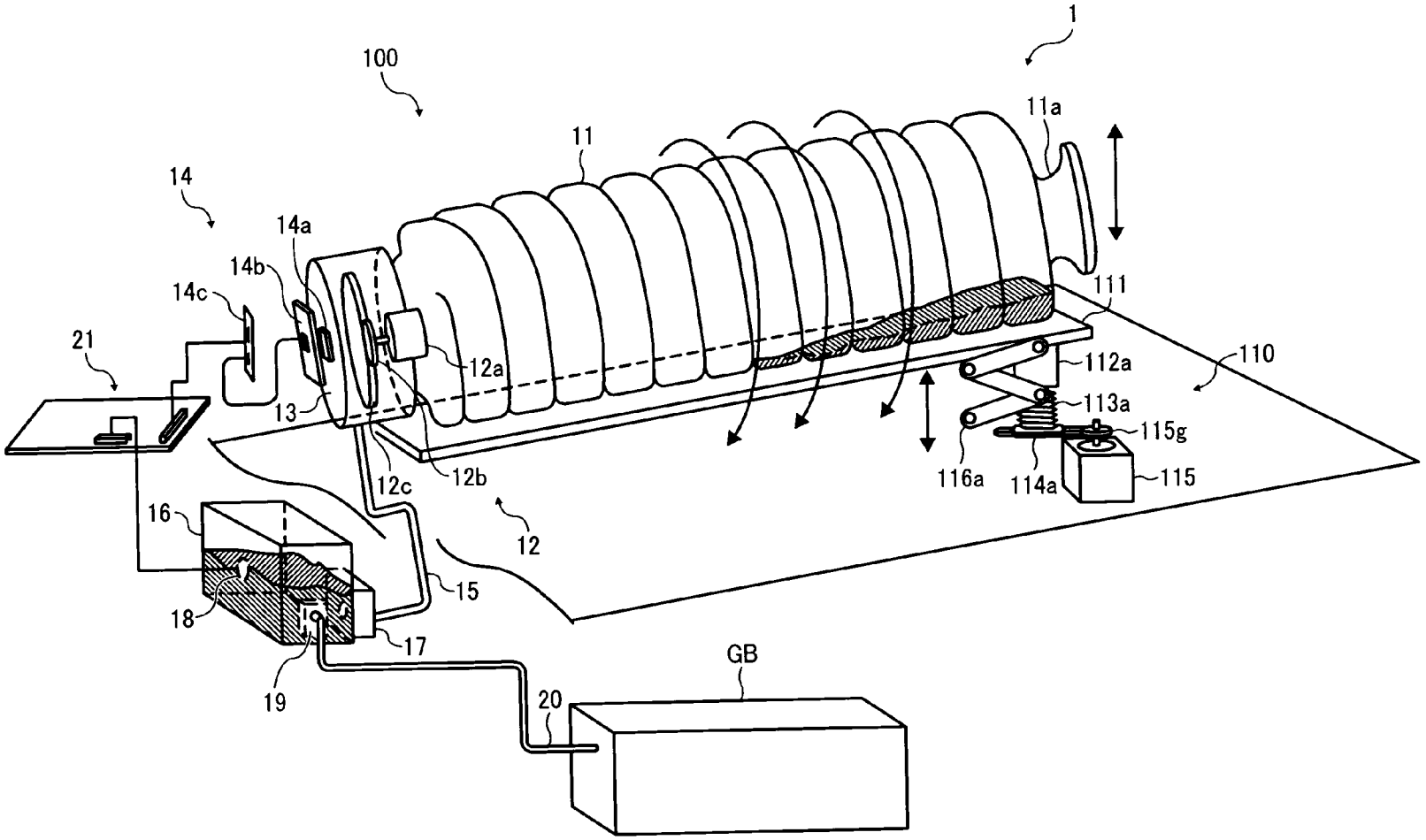
FIG. 9 shows a schematic configuration of toner transport unit according to a second example embodiment employed for an image forming apparatus.

FIGS. 9 to 13 show a developer transport unit, an image forming apparatus, a method of transporting developer, a program for implementing a method of transporting developer, and a storage medium of program according to a second example embodiment. FIG. 9 shows a schematic perspective view of toner supply unit 100 of image forming apparatus 1, which applies a developer transport unit, an image forming apparatus, a method of transporting developer, a program for implementing a method of transporting developer, and a storage medium of program according to a second example embodiment.

The second example embodiment is applied to an image forming apparatus as similar to the image forming apparatus 1 of the first example embodiment. In the second example embodiment, same references or numbers are attached to same parts of the image forming apparatus 1 of the first example embodiment, and the explanation for such parts is simplified or omitted.

FIG. 9 shows a schematic perspective view of a toner supply unit 100 (used as a developer transport unit) of the image forming apparatus 1 according to the second example embodiment. As similar to the toner supply unit 10 of the first example embodiment, the toner supply unit 100 may include the toner bottle 11, the toner forwarding unit 12, the toner ejection unit 13, the toner remaining amount memory/management unit 14, the toner transport route 15, the sub-tank 16, the mohno-pump 17, the toner-full sensor 18, the toner transport motor 19, the toner transport route 20, the controller 21, and a toner forwarding assist mechanism 110.

Figure 10:
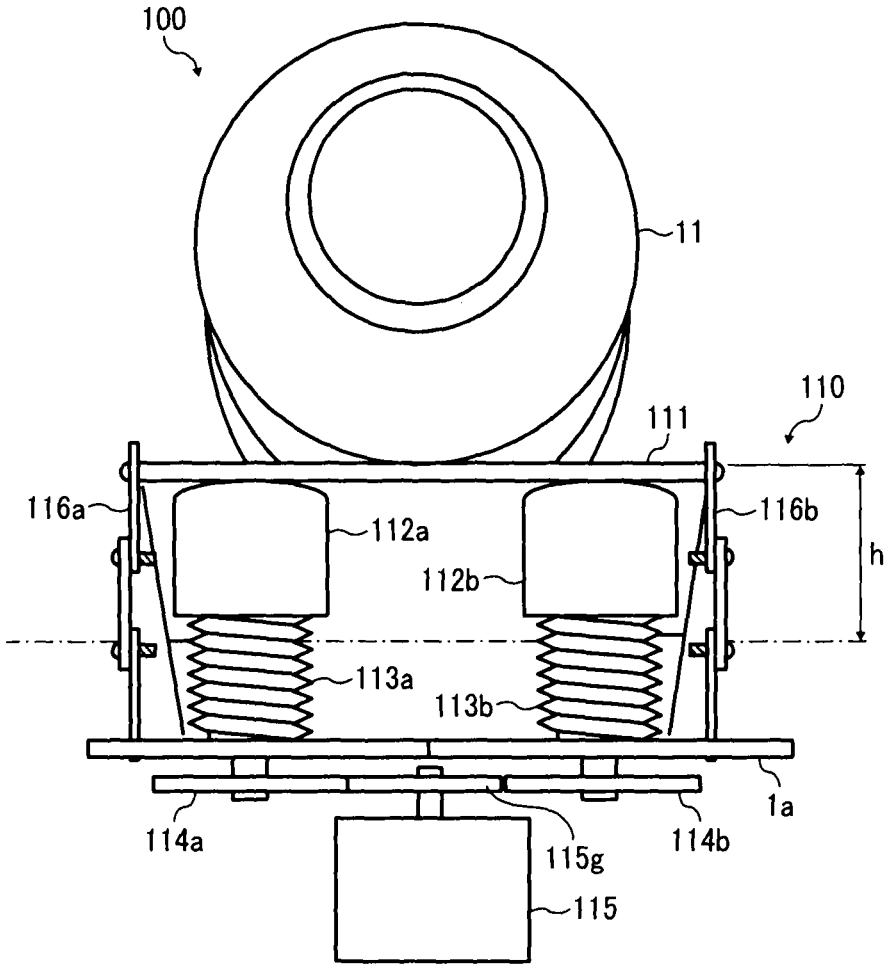
FIG. 10 shows a schematic configuration of a toner forwarding assist mechanism.

As shown in FIG. 10, the toner forwarding assist mechanism 110 (used as push-up device) may include a bottle-rear elevating plate 111, a pair of pushing-up caps 112*a* and 112*b*, cap screws 113*a* and 113*b*, screw gears 114*a* and 114*b*, a pushing-up motor 115, and a pair of support arms 116*a* and 116*b*, for example. A drive shaft of the pushing-up motor 115 is attached to a drive gear 115*g* meshing with the screw gears 114*a* and 114*b* (see FIG. 10).

One end of each of the support arms 116*a* and 116*b*, useable as expandable (and contract-able) arm, may be attached to each side at one end of the bottle-rear elevating plate 111, and the other end of each of the support arms 116*a* and 116*b* may be fixed on a frame 1*a* (see FIG. 10) of the image forming apparatus 1. Accordingly, an end portion of the bottle-rear elevating plate 111 attached with the support arms 116*a* and 116*b* may be referred to as a movable end of the bottle-rear elevating plate 111, and other portion of the bottle-rear elevating plate 111 not attached with the support arms 116*a* and 116*b* may be referred to as a base end of the bottle-rear elevating plate 111.

Accordingly, when the support arms 116*a* and 116*b* expand or contract, the movable end of the bottle-rear elevating plate 111 can be moved upward or downward in a movable range "h" shown in FIG. 10, in which the movable end of the bottle-rear elevating plate 111 is distanced from the frame 1*a* when the movable end is moved upward, and the movable end of the bottle-rear elevating plate 111 is closer to the frame 1*a* when the movable end is moved downward. When the toner forwarding assist mechanism 110 is employed, the toner bottle 11 may be placed on the bottle-rear elevating plate 111 by corresponding the bottom side of the toner bottle 11 to the end side of the bottle-rear elevating plate 111 attached with the support arms 116*a* and 116*b*, which means the bottom side of the toner bottle 11 is placed on the movable end of the bottle-rear elevating plate 111. Accordingly, when the movable end of the bottle-rear elevating plate 111 moves upward or downward direction against the base end of the bottle-rear elevating plate 111, the bottom side of the toner bottle 11 can be moved upward or downward direction against the toner ejection unit 13.

Each of the pushing-up caps 112*a* and 112*b* may be fixed on a back face of the movable end of the bottle-rear elevating plate 111 while the pushing-up caps 112*a* and 112*b* are disposed with a given interval in a width direction of the bottle-rear elevating plate 111, and screw grooves are formed in the each cap 112. The cap screws 113*a* and 113*b* are respectively screwed into the screw grooves of the pushing-up caps 112*a* and 112*b*. Accordingly, when the cap screws 113*a* and 113*b* rotate, the pushing-up caps 112*a* and 112*b* move upward or downward depending on a rotation direction of cap screws 113*a* and 113*b*. Each of the cap screws 113*a* and 113*b*, rotate-ably supported by the frame 1*a*, has a shaft going through the frame 1*a*. Each of the shaft ends of the cap screws 113*a* and 113*b* is fixed with the screw gears 114*a* and 114*b* meshing with the drive gear 115*g* of the pushing-up motor 115 as above described.

Accordingly, the toner forwarding assist mechanism 110 may function as follows: When the pushing-up motor 115 rotates in a pushing-up direction or pushing-down direction, the cap screws 113*a* and 113*b* are rotated via the drive gear 115*g* and the screw gears 114*a* and 114*b*, by which the pushing-up caps 112*a* and 112*b* are moved up or moved down, and resultantly the movable end of the bottle-rear elevating plate 111 is moved up or moved down. When the bottle-rear elevating plate 111 is moved up or moved down, the bottom side of the toner bottle 11 placed on the bottle-rear elevating plate 111 is moved up or moved down.

Figure 11:
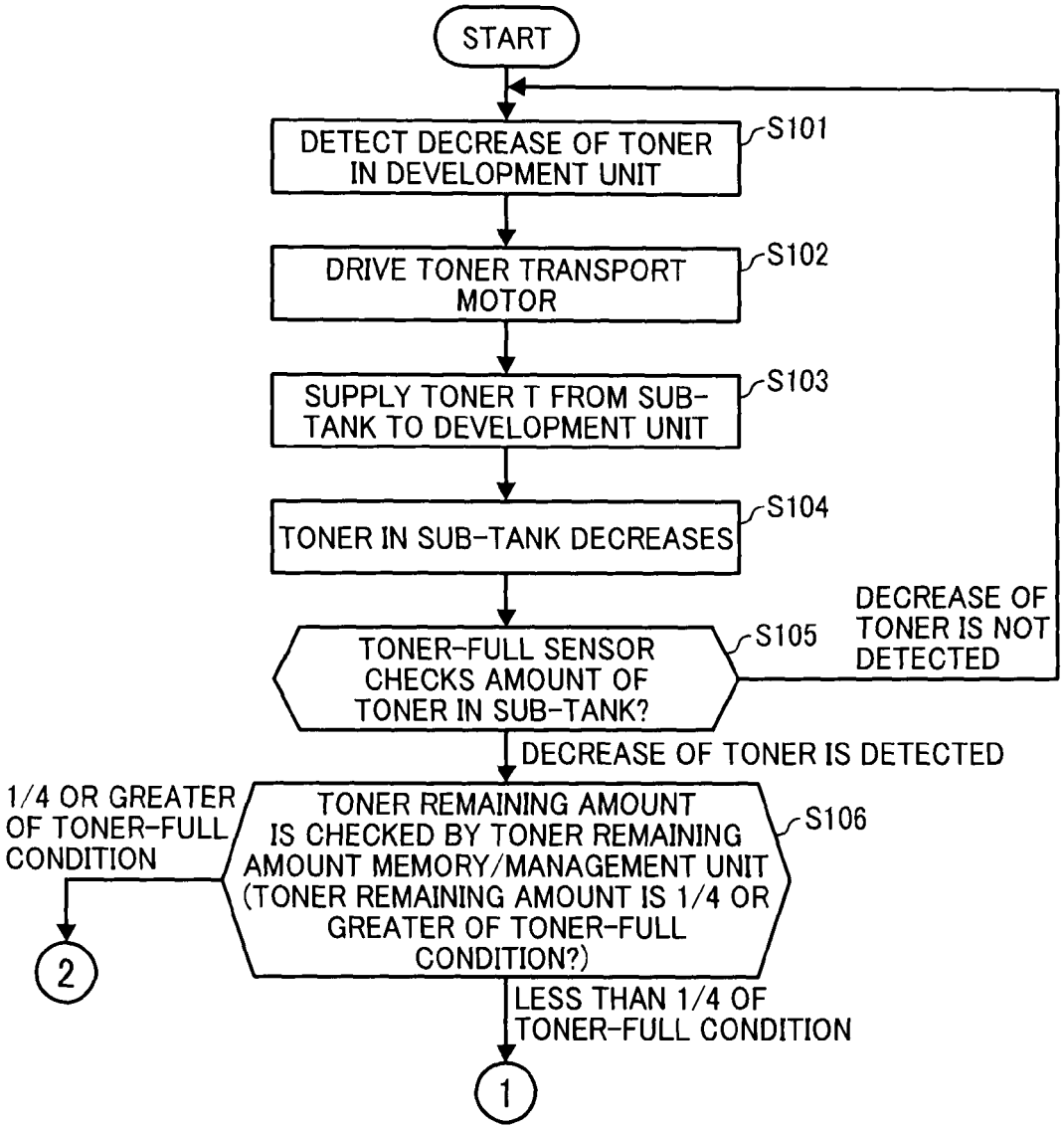
FIG. 11 shows a flowchart explaining toner transport processing by a toner supply unit according to a second example embodiment.
Figure 12:
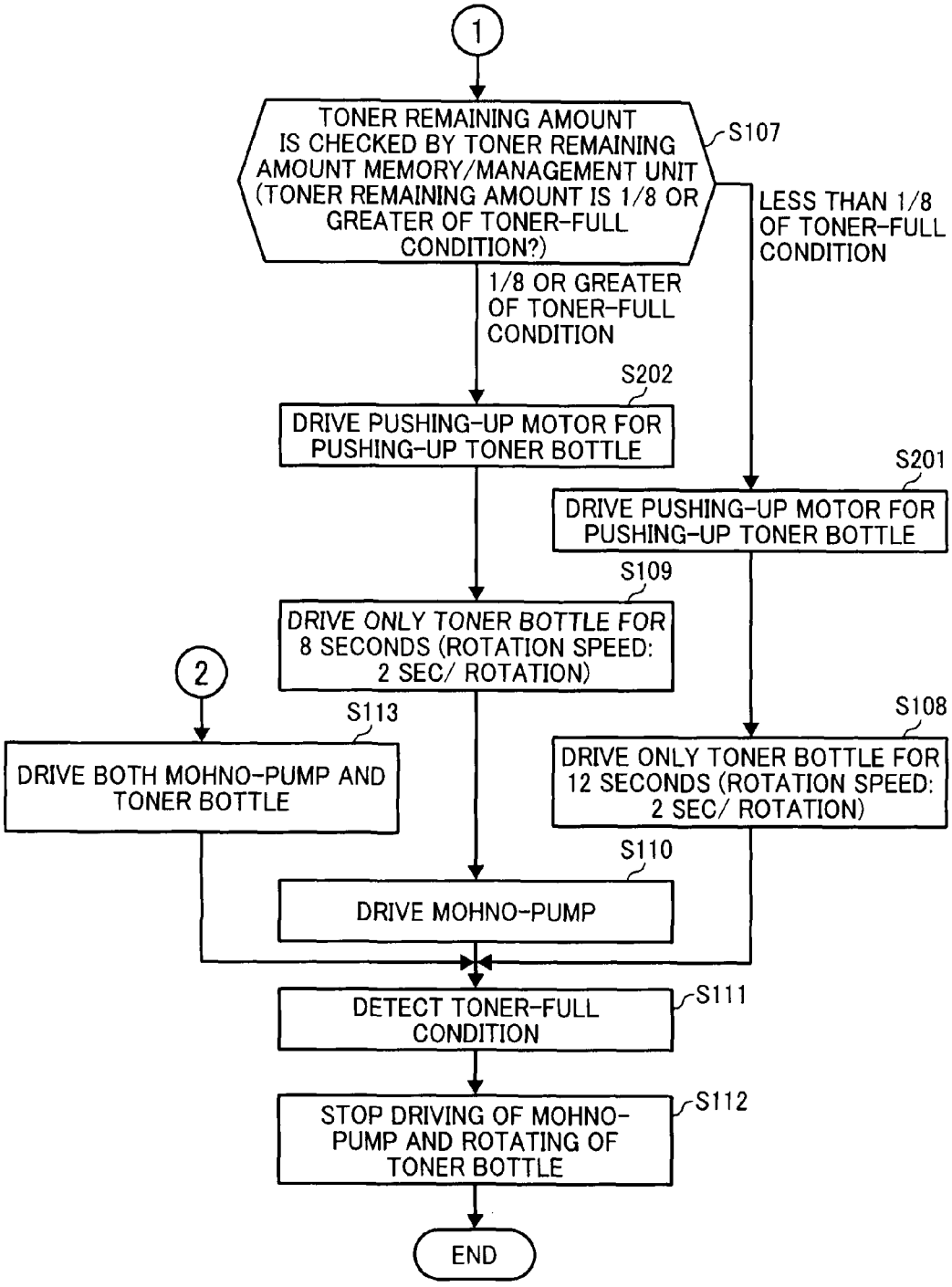
FIG. 12 shows a flowchart of continuation of FIG. 11.

A description is given to effect of the second example embodiment. In the image forming apparatus 1 according to the second example embodiment, the toner supply unit 100 suitably uses the toner forwarding assist mechanism 110, the toner forwarding unit 12 and the mohno-pump 17 to supply the toner T from the toner bottle 11 to the sub-tank 16 as shown in FIGS. 11 and 12 to manage toner remaining amount and prevent malfunction of the mohno-pump 17. In FIGS. 11 and 12, same step numbers are attached to same process steps shown in FIGS. 3A/3B, and the explanation for such steps is simplified or omitted.

As shown in FIG. 11, as for the toner supply unit 100, if a toner detection sensor detects a decrease of toner in the development unit GB (step S101), the controller 21 drives the toner transport motor 19 (step S102), and supplies the toner T from the sub-tank 16 to the development unit GB via the toner transport route 20 (step S103). By supplying toner from the sub-tank 16 to the development unit GB, an amount of toner T in the sub-tank 16 decreases (step S104), and an amount of toner T in the sub-tank 16 is confirmed by the toner-full sensor 18 (step S105).

If the toner-full sensor 18 does not detect a decrease of toner T at step S105, the controller 21 returns the process to step S101, and then conducts the above described processing similarly (steps S101 to S105). If the toner-full sensor 18 detects a decrease of toner T at step S105, toner remaining amount in the toner bottle 11 is checked using the toner remaining amount memory/management unit 14*a* (step S106).

Figure 13:
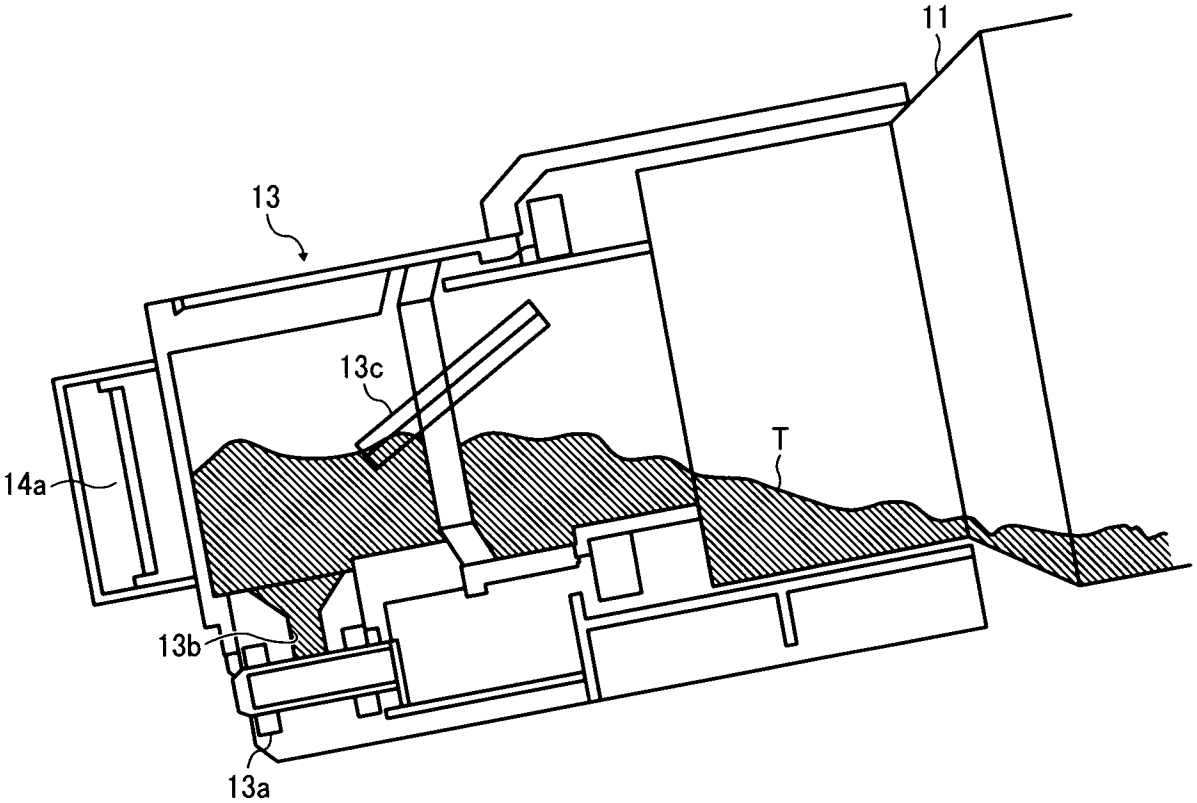
FIG. 13 shows an expanded cross-sectional view of toner ejection unit according to a second example embodiment.

If toner amount remaining in the toner bottle 11 is less than ¼ of toner-full condition at step S106, the controller 21 checks whether toner amount remaining in the toner bottle 11 is ⅛ or greater of toner-full condition (step S107). If toner amount remaining in the toner bottle 11 is less than ⅛ of toner-full condition at step S107, the pushing-up motor 115 of the toner forwarding assist mechanism 110 is driven to push up the bottle-rear elevating plate 111, by which the bottom side of toner bottle 11 is pushed upward as shown by an arrow in FIG. 9 (step S201) and is set at a tilted condition. Then, the controller 21 drives the toner bottle motor 12*a* for 12 seconds (12 sec), for example, while maintaining the toner bottle 11 at the tilted condition by pushing up the bottom side of toner bottle 11, in which the toner bottle 11 is alone rotated at a given speed such as for example 2 seconds per rotation (2 sec/rotation) by the toner forwarding unit 12 to forward the toner T in the toner bottle 11 toward the toner ejection unit 13 efficiently (step S108) as shown in FIG. 13.

If toner amount remaining in the toner bottle 11 is ⅛ or greater of toner-full condition at step S107, the controller 21 drives the pushing-up motor 115 of the toner forwarding assist mechanism 110 to push up the bottle-rear elevating plate 111, by which the bottom side of toner bottle 11 is pushed upward as shown by an arrow in FIG. 9 (step S201), and is set at a tilted condition (step S202). Then, the controller 21 drives the toner bottle motor 12*a* for 8 seconds (8 sec), for example, while maintaining the toner bottle 11 at the tilted condition by pushing up the bottom side of toner bottle 11, in which the toner bottle 11 is alone rotated at a given speed such as for example 2 seconds per rotation (2 sec/rotation) by the toner forwarding unit 12 to forward the toner T in the toner bottle 11 toward the toner ejection unit 13 efficiently (step S109) as shown in FIG. 13.

When the toner T in the toner bottle 11 is forwarded toward the toner ejection unit 13 by using the toner forwarding unit 12 as such, the controller 21 then drives the mohno-pump 17 while forwarding the toner T using the toner forwarding unit 12 (step S110), and if the toner-full sensor 18 detects a toner-full condition (step S111), the controller 21 stops a driving of the mohno-pump 17 and a rotating of the toner bottle 11 by the toner forwarding unit 12 (step S112).

If the toner remaining amount memory/management unit 14 confirms toner amount remaining in the toner bottle 11 is ¼ or greater of toner-full condition at step S106 (FIG. 11), the controller 21 does not activate the toner forwarding assist mechanism 110 for tilting the toner bottle 11, but the controller 21 drives both of the mohno-pump 17 and the toner forwarding unit 12 simultaneously to concurrently conduct a forwarding of the toner T in the toner bottle 11 to the toner ejection unit 13 using the toner forwarding unit 12 and a transportation of the toner T to the sub-tank 16 using the mohno-pump 17 (step S113). If the toner-full sensor 18 detects a toner-full condition (step S111), the controller 21 stops a driving of the mohno-pump 17 and a rotating of the toner bottle 11 by the toner forwarding unit 12 (step S112).

As such, the toner supply unit 100 of the image forming apparatus 1 according to the second example embodiment includes the toner forwarding assist mechanism 110, which can push up the bottom side of the toner bottle 11, which is an opposite end with respect to the toner ejection unit 13. Specifically, based on toner amount remaining in the toner bottle 11 obtained by using the toner remaining amount memory/management unit 14, the controller 21 drives the toner forwarding assist mechanism 110 to push up the bottom side of the toner bottle 11, which is an opposite end with respect to the toner ejection unit 13, and also drives the toner forwarding unit 12.

Accordingly, by tilting the toner bottle 11 toward the toner ejection unit 13, the toner T in the toner bottle 11 can flow down in a direction toward the toner ejection unit 13 with an effect of the gravity force, and the toner T in the toner bottle 11 can be forwarded toward the toner ejection unit 13 by using the toner forwarding unit 12. As a result, the toner T in the toner bottle 11 can be moved to the toner ejection unit 13 with a shorter time, and can prevent air suction by the mohno-pump 17, by which toner transport amount of the toner T transported from the toner ejection unit 13 to the sub-tank 16 by the mohno-pump 17 can be stabilized, and thereby a management of toner amount remaining in the toner bottle 11 can be conducted more correctly. In the above described example embodiment, a certain amount of toner and/or a certain speed may be used to determine a condition of toner transport processing, but it should be noted such values are just example values, and other values can be applied as required.

(Third Example Embodiment)

Figure 14:
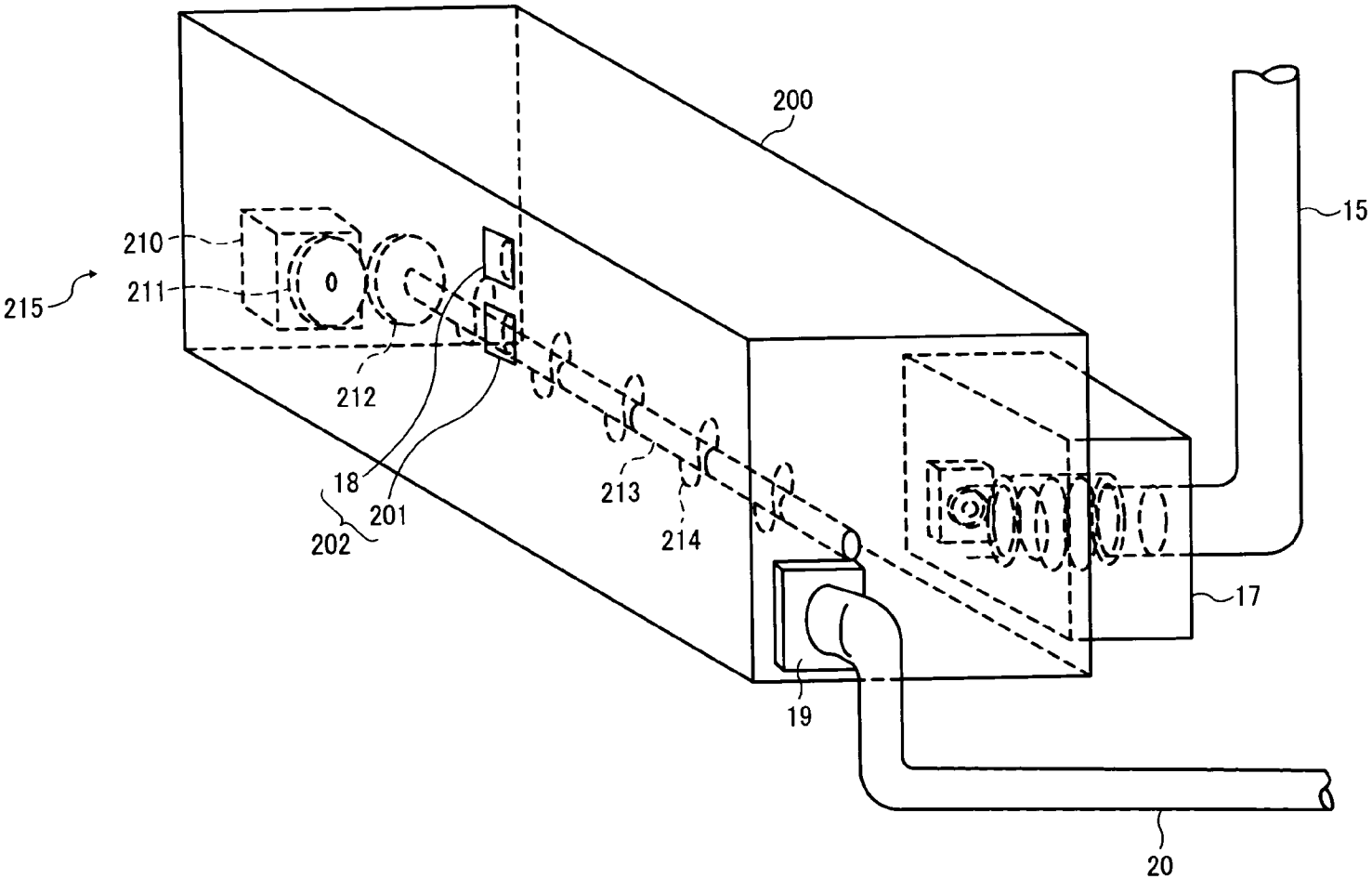
FIG. 14 shows a perspective view of a sub-tank according to a third example embodiment.
Figure 15:
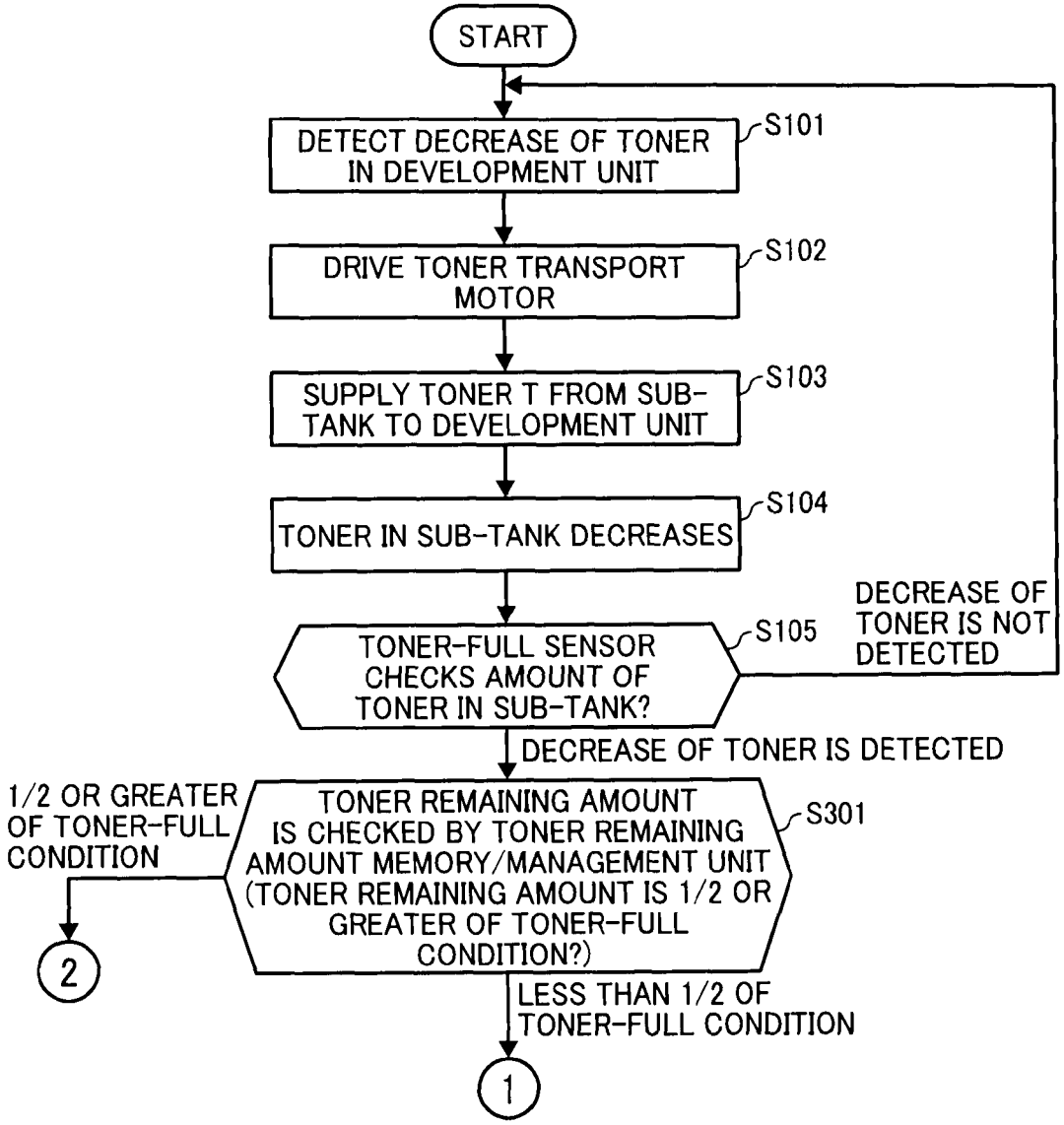
FIG. 15 shows a flowchart explaining toner transport processing by a toner supply unit according to a third example embodiment.
Figure 16:
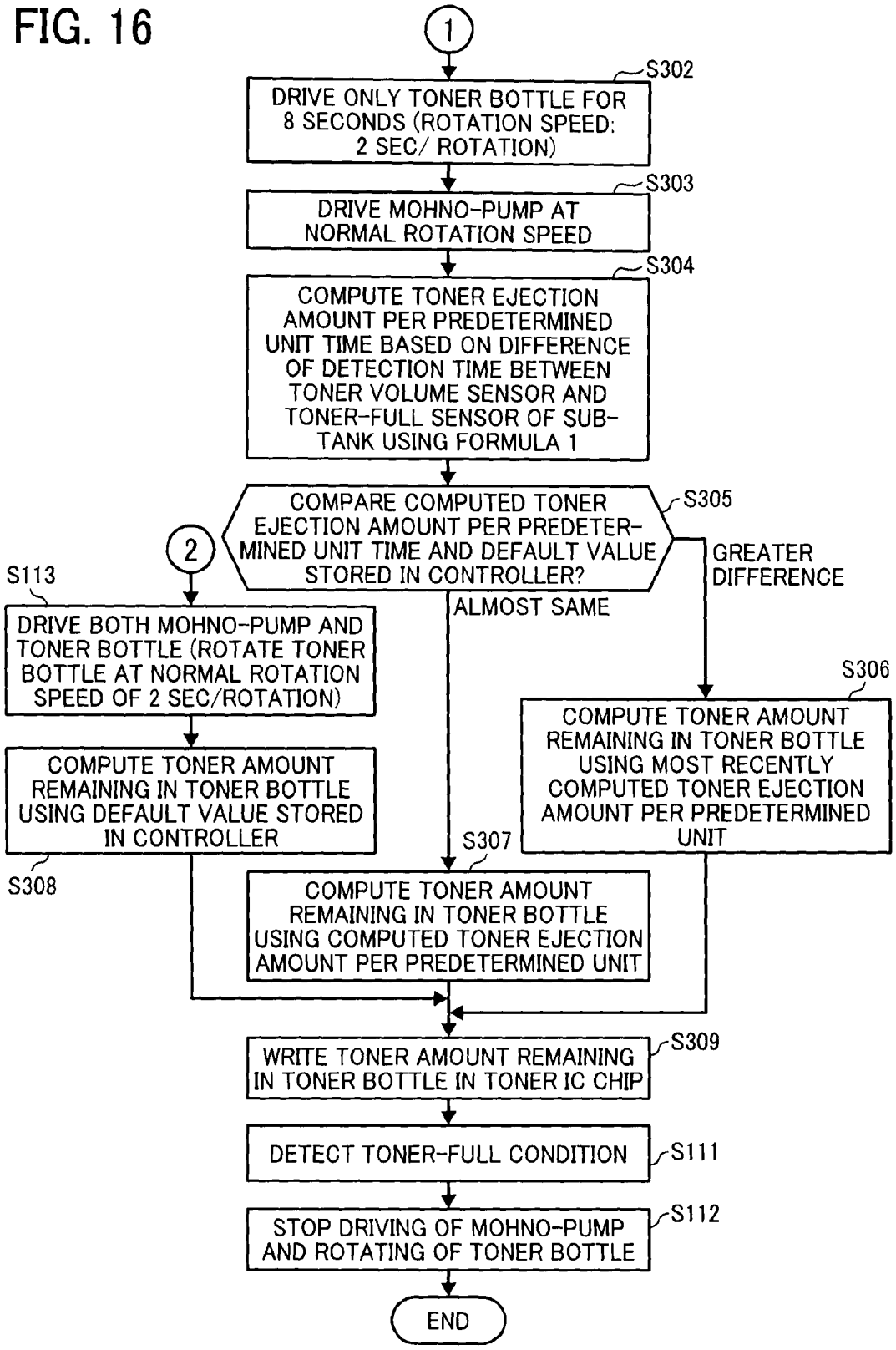
FIG. 16 shows a flowchart of continuation of FIG. 15.

FIGS. 14 to 16 show a developer transport unit, an image forming apparatus, a method of transporting developer, a program for implementing a method of transporting developer, and a storage medium of program according to a third example embodiment. FIG. 14 shows a schematic perspective view of a sub-tank 200 of image forming apparatus 1, which applies a developer transport unit, an image forming apparatus, a method of transporting developer, a program for implementing a method of transporting developer, and a storage medium of program according to a third example embodiment.

The third example embodiment is applied to an image forming apparatus as similar to the image forming apparatus 1 of the first example embodiment. In the third example embodiment, same references or numbers are attached to same parts of the image forming apparatus 1 of the first example embodiment, and the explanation for such parts is simplified or omitted.

FIG. 14 shows a schematic perspective view of the sub-tank 200 of the image forming apparatus 1 according to the third example embodiment. As similar to the sub-tank 16 of the first example embodiment, the sub-tank 200 is provided with the mohno-pump 17, the toner-full sensor 18, the toner transport motor 19, and further provided with a toner volume sensor 201, in which the mohno-pump 17 is connected to the toner transport route 15, and the toner transport motor 19 is connected to the toner transport route 20.

As shown in FIG. 14, an attachment position of the toner volume sensor 201 is set lower than an attachment position of the toner-full sensor 18, which means the toner volume sensor 201 is set closer to a bottom side of the sub-tank 16 compared to the toner-full sensor 18. Accordingly, the toner amount in the sub-tank 16 detectable by the toner volume sensor 201 is set smaller than the toner amount detectable by the toner-full sensor 18 for a certain amount. As such, the attachment positions of the toner-full sensor 18 and toner volume sensor 201 on the sub-tank 16 are set differently. Accordingly, toner transport amount per predetermined unit of time by the mohno-pump 17 can be detected based on an amount, which is a difference between a toner amount detectable by toner-full sensor 18 and a toner amount detectable by toner volume sensor 201, and a time required for transporting such amount by the mohno-pump 17. Therefore, the toner-full sensor 18 and the toner volume sensor 201 may function as a toner transport amount detector 202.

Further, the sub-tank 200 may include an agitation motor 210, a drive gear 211, a shaft gear 212, and a toner agitation shaft 213, for example. When the agitation motor 210 is driven, the toner agitation shaft 213 rotates via the drive gear 211 and the shaft gear 212. The toner agitation shaft 213 is attached with agitation vanes 214 spirally formed thereon, and the toner agitation shaft 213 extends in a shaft direction in the sub-tank 200. In the sub-tank 200, the toner agitation shaft 213 can be rotated by the agitation motor 210 to rotate the agitation vanes 214, by which the toner T in the sub-tank 200 can be agitated. Accordingly, the agitation motor 210, the drive gear 211, the shaft gear 212, the toner agitation shaft 213, and the agitation vanes 214 may function as an agitation unit 215 (used as agitation device) to uniformly agitate the toner T in the sub-tank 200 as a whole.

A description is given to effect of the third example embodiment. In the toner supply unit 100 of image forming apparatus 1 according to the third example embodiment, toner ejection amount from the toner bottle 11 to the sub-tank 200 can be detected more correctly, and toner supply from the toner bottle 11 to the sub-tank 200 by the toner forwarding unit 12 and the mohno-pump 17 is suitably conducted as shown in FIGS. 15 and 16 to manage toner remaining amount and prevent malfunction of the mohno-pump 17. In FIGS. 15 and 16, same step numbers are attached to same process steps shown in FIGS. 3A/3B, and the explanation for such steps is simplified or omitted.

As shown in FIG. 15, as for the toner supply unit 10, if a toner detection sensor detects a decrease of toner amount in the development unit GB (step S101), the controller 21 drives the toner transport motor 19 (step S102), and supplies the toner T from the sub-tank 200 to the development unit GB via the toner transport route 20 (step S103). By supplying toner from the sub-tank 200 to the development unit GB, an amount of toner T in the sub-tank 200 decreases (step S104), and an amount of toner T in the sub-tank 200 is confirmed by the toner-full sensor 18 (step S105).

If the toner-full sensor 18 does not detect a decrease of toner T at step S105, the controller 21 returns the process to step S101, and then conducts the above described processing similarly (steps S101 to S105).

If the toner-full sensor 18 detects a decrease of toner T at step S105, the controller 21 reads out information of toner amount remaining in the toner bottle 11, stored in the toner IC chip 14*a*, and then checks whether toner remaining amount in the toner bottle 11 is ½ or greater of toner-full condition (step S301).

If toner amount remaining in the toner bottle 11 is less than ½ of toner-full condition at step S301, as shown in FIG. 16, the controller 21 drives the toner bottle motor 12*a* for 8 seconds (8 sec), for example, in which the toner bottle 11 is alone rotated at a given speed such as for example 2 seconds per rotation (2 sec/rotation) by the toner forwarding unit 12 to forward the toner T in the toner bottle 11 toward the toner ejection unit 13 (step S302).

When the toner T in the toner bottle 11 is forwarded toward the toner ejection unit 13 by using the toner forwarding unit 12 as such, the controller 21 then drives the mohno-pump 17 at the normal speed while forwarding the toner T using the toner forwarding unit 12 (step S303).

Based on a toner detection results by the toner volume sensor 201 and a toner detection results by the toner-full sensor 18, which are used to detect an amount of toner in the sub-tank 200, toner ejection amount per predetermined unit of time from the toner ejection unit 13 of the toner bottle 11 to the sub-tank 200 is computed (step S304). Specifically, the controller 21 can compute toner ejection amount per predetermined unit of time using a following formula (1), in which a "difference of toner amount" is a difference of a toner amount detected by the toner volume sensor 201 and a toner amount detected by the toner-full sensor 18, and "time" is difference of time between a detection timing of toner by the toner volume sensor 201 and a detection time of toner by the toner-full sensor 18.

Toner ejection per predetermined unit of time="difference of toner amount"/"difference of time"=(difference of toner amount between toner amount detected by toner volume sensor 201 and toner amount detected by toner-full sensor 18/time difference between detection timing of toner by toner volume sensor 201 and detection timing of toner by toner-full sensor 18) (1)

After computing the toner ejection amount per predetermined unit of time, the controller 21 compares the computed toner ejection amount per predetermined unit of time (i.e., computed toner ejection amount) and a predicted toner ejection amount stored in the controller 21 as a default value (step S305). If the computed toner ejection amount and the predicted toner ejection amount have a greater difference, the currently computed toner ejection amount may not be used, but a most recently computed toner ejection amount per predetermined unit of time may be used to compute toner amount remaining in the toner bottle 11 (step S306).

If the computed toner ejection amount and the predicted toner ejection amount are almost same (or substantially same) at step S305, the controller 21 computes toner amount remaining in the toner bottle 11 using the computed toner ejection amount per predetermined unit of time (i.e., computed toner ejection amount) (step S307).

Further, if toner amount remaining in the toner bottle 11 is confirmed ½ or greater of toner-full condition by the toner remaining amount memory/management unit 14 at step S301 (FIG. 15), the controller 21 drives both of the mohno-pump 17 and the toner forwarding unit 12 simultaneously to concurrently conduct a forwarding of the toner T in the toner bottle 11 to the toner ejection unit 13 using the toner forwarding unit 12 and a transportation of the toner T to the sub-tank 16 using the mohno-pump 17 (step S113) as shown in FIG. 16. In such a case, the toner bottle 11 is rotated at the normal rotation speed such as for example 2 sec/rotation speed by the toner forwarding unit 12. Then, the controller 21 computes toner amount remaining in the toner bottle 11 using the predicted toner ejection amount (i.e., default value) stored in the controller 21 (step S308).

After computing the toner amount remaining in the toner bottle 11, the controller 21 writes and stores the computed toner amount remaining in the toner bottle 11 to the toner IC chip 14*a* via the antenna member 14*b* under a control of the antenna operation controller 14*c* of the toner remaining amount memory/management unit 14 (step S309). If the toner-full sensor 18 detects a toner-full condition (step S111), the controller 21 stops a driving of the mohno-pump 17 and a rotating of the toner bottle 11 by the toner forwarding unit 12 (step S112).

As above described, the image forming apparatus 1 according to the third example embodiment includes the sub-tank 200 employing the toner-full sensor 18 and the toner volume sensor 201 as the toner transport amount detector 202 to detect toner transport amount per predetermined unit of time. Based on the toner transport amount per predetermined unit of time detected by the toner transport amount detector 202 and a driving time of the mohno-pump 17, the toner amount remaining in the toner bottle 11 can be computed.

Accordingly, an amount of toner transported from the toner ejection unit 13 of the toner bottle 11 to the sub-tank 200 by the mohno-pump 17 can be computed based on an effective rotation time of the toner bottle 11 or a detection result of the toner transport amount detector 202, in which toner is supplied to the sub-tank 200 within a given time that the mohno-pump 17 is driven. With such a configuration, even if toner transport amount transportable by the mohno-pump 17 decreases in response to a decrease of toner amount in the toner bottle 11, toner amount remaining in the toner bottle 11 can be correctly detected, and further a difference between toner amount remaining in the toner bottle 11 obtained from a detection result of the toner transport amount detector 202 and an actual toner amount remaining in the toner bottle 11 can be reduced, by which toner amount remaining in the toner bottle 11 can be obtained correctly.

Further, in the image forming apparatus 1 according to the third example embodiment, the sub-tank 200 includes the agitation motor 210, the drive gear 211, the shaft gear 212, the toner agitation shaft 213, and the agitation vanes 214 as the agitation unit 215 as a whole to agitate the toner T uniformly in the sub-tank 200.

Accordingly, under a condition that the height of toner in the sub-tank 200 is maintained at a given uniform height, the toner transport amount by the mohno-pump 17 can be detected using the toner-full sensor 18 and the toner volume sensor 201, and toner amount remaining in the toner bottle 11 can be computed. Accordingly, toner amount remaining in the toner bottle 11 can be computed and obtained more correctly, by which a management of toner amount remaining in the toner bottle 11 using the toner remaining amount memory/management unit 14 can be conducted more correctly.

Further, in the image forming apparatus 1 according to the third example embodiment, a driving time and driving speed (or toner transport speed) of the toner forwarding unit 12, and a driving speed (or toner transport speed) of the mohno-pump 17 can be controlled based on the correctly obtained toner amount remaining in the toner bottle 11.

Accordingly, toner transportation from the toner bottle 11 to the sub-tank 200 can be conducted more precisely. In the above described example embodiment, a certain amount of toner and/or a certain speed may be used to determine a condition of toner transport processing, but it should be noted such values are just example values, and other values can be applied as required. Further, the above described first to third example embodiments may be applied alone or in combination.

As for the above described developer transport unit, the developer storage vessel is detachably attached to the developer ejection unit (or toner ejection unit), and developer can be suitably transported from the developer ejection unit to the sub-storage vessel (or sub-supply container), and developer amount in the developer storage vessel can be suitably managed. As such, a developer transport unit, an image forming apparatus, a method of transporting developer, a program for implementing a method of transporting developer, and storage medium of program according to example embodiments can be provided.

The above described example embodiments can be applied to a developer transport unit that transports developer from a developer storage vessel such as a toner bottle or the like to a development unit via a sub-storage vessel (or sub-supply container) such as a sub-tank or the like, and an image forming apparatus employing such developer transport unit, a method of transporting developer by employing such developer transport unit, a program for implementing a method of transporting developer by employing such developer transport unit, and a storage medium of such program can be devised.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A developer transport unit for refilling developer in a developing unit used for developing an electrostatic latent image formed on a photoconductor by applying developer, comprising:

an intra-vessel transporting device to transport developer in a developer storage vessel to an ejection unit, the developer storage vessel attached at one end to the ejection unit;

a transport/supply device to transport the developer from the ejection unit into a sub-storage vessel;

an intermediate-developer amount detector which detects developer present in the sub-storage vessel; and a control unit to control driving of the intra-vessel transporting device and the transport/supply device, wherein detection of a predetermined amount of developer in the sub-storage vessel by the intermediate-developer amount detector causes the control unit to, as a first developer driving action after detection of the predetermined amount before performing any other developer driving action, drive the intra-vessel transporting device for a given time without driving the transport/supply device, and then subsequently drive the transport/supply device along with the intra-vessel transporting device until the intermediate-developer amount detector detects that the sub-storage vessel is refilled, the developer transport unit further comprising an intra-vessel developer amount detector to obtain an amount of the developer present in the developer storage vessel, wherein the control unit adjusts a transport speed of developer to be transported from the developer storage vessel to the ejection unit by the intra-vessel transporting device based on an amount of the developer present in the developer storage vessel obtained by the intra-vessel developer amount detector such that as a detected amount of the developer present in the developer storage vessel obtained by the intra-vessel developer amount detector decreases, the control unit increases the transport speed of the developer to be transported from the developer storage vessel to the ejection unit by the intra-vessel transporting device, and wherein the control unit adjusts a transport speed of developer transported from the ejection unit to the sub-storage vessel by the transport/supply device based on an amount of the developer present in the developer storage vessel obtained by the intra-vessel developer amount detector.

2. The developer transport unit of claim 1, wherein the intra-vessel developer amount detector computes and obtains a current amount of the developer present in the developer storage vessel based on a driving time of the transport/supply device.

3. The developer transport unit of claim 2, wherein the control unit drives the intra-vessel transporting device alone for the given time determined using the amount of the developer present in the developer storage vessel obtained by the intra-vessel developer amount detector, and then drives the transport/supply device along with the intra-vessel transporting device.

4. The developer transport unit of claim 1, wherein the developer storage vessel is cylindrical and an inner face of the developer storage vessel forms a spiral pattern extending toward the ejection unit, wherein the intra-vessel transporting device includes a rotating device that rotates the developer storage vessel in a direction that moves the developer in the developer storage vessel to the ejection unit using the spiral pattern of the developer storage vessel.

5. The developer transport unit of claim 4, further comprising a push-up device to push up an end of the developer storage vessel opposite the end attached to the ejection unit, in a upward direction, wherein, depending on an amount of the developer present in the developer storage vessel obtained by the intra-vessel developer amount detector, the control unit instructs the push-up device to push up the end of the developer storage vessel opposite the end attached to the ejection unit, and concurrently drives the intra-vessel transporting device.

6. An image forming apparatus, comprising:

the developer transport unit of claim 1; and the photoconductor, wherein developer is stored in the developer storage vessel attached at one end to the ejection unit and transported to the sub-storage vessel from the ejection unit by the developer transport unit and further transported to the developing unit used for developing the electrostatic latent image formed on the photoconductor by applying developer, the developed image on the photoconductor being transferred to a recording medium to conduct an image forming operation.

7. A developer transport unit for refilling developer in a developing unit used for developing an electrostatic latent image formed on a photoconductor by applying developer, comprising:

an intra-vessel transporting device to transport developer in a developer storage vessel to an ejection unit, the developer storage vessel attached at one end to the ejection unit;

a transport/supply device to transport the developer from the ejection unit into a sub-storage vessel;

an intermediate-developer amount detector which detects developer present in the sub-storage vessel; and a control unit to control driving of the intra-vessel transporting device and the transport/supply device, wherein detection of a predetermined amount of developer in the sub-storage vessel by the intermediate-developer amount detector causes the control unit to, as a first developer drivin action after detection of the redetermined amount before performing any other developer driving action, drive the intra-vessel transporting device for a given time without driving the transport/supply device, and then subsequently drive the transport/supply device along with the intra-vessel transporting device until the intermediate-developer amount detector detects that the sub-storage vessel is refilled, the developer transport unit further comprising an intra-vessel developer amount detector to obtain an amount of the developer present in the developer storage vessel, wherein the control unit adjusts a transport speed of developer to be transported from the developer storage vessel to the ejection unit by the intra-vessel transporting device based on an amount of the developer present in the developer storage vessel obtained by the intra-vessel developer amount detector such that as a detected amount of the developer present in the developer storage vessel obtained by the intra-vessel developer amount detector decreases, the control unit increases the transport speed of the developer to be transported from the developer storage vessel to the ejection unit by the intra-vessel transporting device, and wherein the intra-vessel developer amount detector computes and obtains a current amount of developer present in the developer storage vessel based on a last known amount of developer in the developer storage vessel and a driving time of the transport/supply device.

8. A developer transport unit for refilling developer in a developing unit used for developing an electrostatic latent image formed on a photoconductor by applying developer, comprising:

an intra-vessel transporting device to transport developer in a developer storage vessel to an ejection unit, the developer storage vessel attached at one end to the ejection unit;

a transport/supply device to transport the developer from the ejection unit into a sub-storage vessel;

an intermediate-developer amount detector which detects developer present in the sub-storage vessel; and a control unit to control driving of the intra-vessel transporting device and the transport/supply device, wherein detection of a predetermined amount of developer in the sub-storage vessel by the intermediate-developer amount detector causes the control unit to, as a first developer driving action after detection of the predetermined amount before performing any other developer driving action, drive the intra-vessel transporting device for a given time without driving the transport/supply device, and then subsequently drive the transport/supply device along with the intra-vessel transporting device until the intermediate-developer amount detector detects that the sub-storage vessel is refilled, the developer transport unit further comprising an intra-vessel developer amount detector to obtain an amount of the developer present in the developer storage vessel, wherein the control unit adjusts a transport speed of developer to be transported from the developer storage vessel to the ejection unit by the intra-vessel transporting device based on an amount of the developer present in the developer storage vessel obtained by the intra-vessel developer amount detector such that as a detected amount of the developer present in the developer storage vessel obtained by the intra-vessel developer amount detector decreases, the control unit increases the transport speed of the developer to be transported from the developer storage vessel to the ejection unit by the intra-vessel transporting device, the developer transport unit further comprising a transport amount detector to detect a transport amount of the developer per predetermined unit of time transported to the sub-storage vessel by the transport/supply device, wherein an amount of the developer present in the developer storage vessel is computed based on a transport amount of the developer per predetermined unit of time detected by the transport amount detector and a driving time of the transport/supply device.

9. The developer transport unit of claim 8, wherein the sub-storage vessel includes an agitation unit to agitate developer in the sub-storage vessel, wherein, while the agitation unit is agitating developer in the sub-storage vessel transported from the ejection unit by the transport/supply device, the transport amount detector detects an increased amount of the developer increased per predetermined unit of time in the sub-storage vessel as the transport amount.

10. A method of transporting developer to a developing unit used for developing an electrostatic latent image formed on a photoconductor by applying developer, the method comprising the steps of:

intra-vessel transporting developer in a developer storage vessel to an ejection unit, the developer storage vessel attached at one end to the ejection unit;

inter-vessel transporting the developer from the ejection unit into a sub-storage vessel;

detecting the developer in the sub-storage vessel; and controlling a driving of the intra-vessel transporting and the inter-vessel transporting, wherein detection of a predetermined amount of developer in the sub-storage vessel in the detecting causes, as a first developer driving action after detection of the predetermined amount before performing any other developer driving action, the intra-vessel transporting to be executed for a predetermined time without driving the inter-vessel transporting device, after which the inter-vessel transporting is executed along with the intra-vessel transporting until the detecting step detects that the sub-storage vessel is refilled, the method further comprising:

detecting an amount of the developer present in the developer storage vessel, wherein the controlling adjusts a transport speed of developer to be transported from the developer storage vessel to the ejection unit by the intra-vessel transporting based on the amount of the developer present in the developer storage vessel which has been detected such that as a detected amount of the developer present in the developer storage vessel obtained by the intra-vessel developer amount detector decreases, the controlling increases the transport speed of the developer to be transported from the developer storage vessel to the ejection unit by the intra-vessel transporting, and wherein the control unit adjusts a transport speed of developer transported from the ejection unit to the sub-storage vessel by the transport/supply device based on an amount of the developer present in the developer storage vessel obtained by the intra-vessel developer amount detector.

11. A non-transitory computer-readable medium storing a program comprising instructions that when executed by a computer cause the computer to execute a method of transporting developer to a developing unit used for developing an electrostatic latent image formed on a photoconductor by applying developer, the method comprising the steps of:

intra-vessel transporting developer in the developer storage vessel to an ejection unit, the developer storage vessel detachably attached at one end to the ejection unit;

inter-vessel transporting the developer from the ejection unit into a sub-storage vessel;

detecting the developer in the sub-storage vessel; and controlling a driving of the intra-vessel transporting and the inter-vessel transporting step, wherein detection of a predetermined amount of developer in the sub-storage vessel in the detecting causes, as a first developer driving action after detection of the predetermined amount before performing any other developer driving action, the intra-vessel transporting to be executed for a predetermined period of time without driving the inter-vessel transporting device, after which the inter-vessel transporting is executed along with the intra-vessel transporting until the detecting step detects that the sub-storage vessel is refilled, the method further comprising:

detecting an amount of the developer present in the developer storage vessel, wherein the controlling adjusts a transport speed of developer to be transported from the developer storage vessel to the ejection unit by the intra-vessel transporting based on the amount of the developer present in the developer storage vessel which has been detected such that as a detected amount of the developer present in the developer storage vessel obtained by the intra-vessel developer amount detector decreases, the controlling increases the transport speed of the developer to be transported from the developer storage vessel to the ejection unit by the intra-vessel transporting, and wherein the control unit adjusts a transport speed of developer transported from the ejection unit to the sub-storage vessel by the transport/supply device based on an amount of the developer present in the developer storage vessel obtained by the intra-vessel developer amount detector.

12. A method of transporting developer to a developing unit used for developing an electrostatic latent image formed on a photoconductor by applying developer, the method comprising the steps of:

intra-vessel transporting developer in a developer storage vessel to an ejection unit, the developer storage vessel attached at one end to the ejection unit;

inter-vessel transporting the developer from the ejection unit into a sub-storage vessel;

detecting the developer in the sub-storage vessel; and controlling a driving of the intra-vessel transporting and the inter-vessel transporting, wherein detection of a predetermined amount of developer in the sub-storage vessel in the detecting causes, as a first developer driving action after detection of the predetermined amount before performing any other developer driving action, the intra-vessel transporting to be executed for a predetermined time without driving the inter-vessel transporting device, after which the inter-vessel transporting is executed along with the intra-vessel transporting until the detecting step detects that the sub-storage vessel is refilled, the method further comprising:

detecting an amount of the developer present in the developer storage vessel, wherein the controlling adjusts a transport speed of developer to be transported from the developer storage vessel to the ejection unit by the intra-vessel transporting based on the amount of the developer present in the developer storage vessel which has been detected such that as a detected amount of the developer present in the developer storage vessel obtained by the intra-vessel developer amount detector decreases, the controlling increases the transport speed of the developer to be transported from the developer storage vessel to the ejection unit by the intra-vessel transporting.

the method further comprising computing a current amount of developer present in the developer storage vessel based on a last known amount of developer in the developer storage vessel and a driving time of the transport/supply device.

13. A method of transporting developer to a developing unit used for developing an electrostatic latent image formed on a photoconductor by applying developer, the method comprising the steps of:

intra-vessel transporting developer in a developer storage vessel to an ejection unit, the developer storage vessel attached at one end to the ejection unit;

inter-vessel transporting the developer from the ejection unit into a sub-storage vessel;

detecting the developer in the sub-storage vessel; and controlling a driving of the intra-vessel transporting and the inter-vessel transporting, wherein detection of a predetermined amount of developer in the sub-storage vessel in the detecting causes, as a first developer driving action after detection of the predetermined amount before performing any other developer driving action, the intra-vessel transporting to be executed for a predetermined time without driving the inter-vessel transporting device, after which the inter-vessel transporting is executed along with the intra-vessel transporting until the detecting step detects that the sub-storage vessel is refilled, the method further comprising:

detecting an amount of the developer present in the developer storage vessel, wherein the controlling adjusts a transport speed of developer to be transported from the developer storage vessel to the ejection unit by the intra-vessel transporting based on the amount of the developer present in the developer storage vessel which has been detected such that as a detected amount of the developer present in the developer storage vessel obtained by the intra-vessel developer amount detector decreases, the controlling increases the transport speed of the developer to be transported from the developer storage vessel to the ejection unit by the intra-vessel transporting, and wherein an amount of the developer present in the developer storage vessel is computed based on a transport amount of the developer per predetermined unit of time detected by a transport amount detector which detects a transport amount of the developer per predetermined unit of time transported to the sub-storage vessel by the transport/supply device, and computed based on a driving time of the transport/supply device.

* * * * *